US011131193B2

(12) United States Patent
Lindsey

(10) Patent No.: US 11,131,193 B2
(45) Date of Patent: Sep. 28, 2021

(54) ROTARY PISTON AND CYLINDER DEVICE

(71) Applicant: LONTRA LIMITED, Southam (GB)

(72) Inventor: Stephen Francis Lindsey, Southam (GB)

(73) Assignee: LONTRA LIMITED, Southam (GB)

( * ) Notice: Subject to any disclaimer, the term of this patent is extended or adjusted under 35 U.S.C. 154(b) by 69 days.

(21) Appl. No.: 16/329,921

(22) PCT Filed: Sep. 1, 2017

(86) PCT No.: PCT/GB2017/052557
§ 371 (c)(1),
(2) Date: Mar. 1, 2019

(87) PCT Pub. No.: WO2018/042195
PCT Pub. Date: Mar. 8, 2018

(65) Prior Publication Data

US 2019/0186264 A1 Jun. 20, 2019

(30) Foreign Application Priority Data

Sep. 2, 2016 (GB) ..... 1614976

(51) Int. Cl.
*F01C 11/00* (2006.01)
*F03C 2/00* (2006.01)
(Continued)

(52) U.S. Cl.
CPC ..... *F01C 19/02* (2013.01); *F01C 3/02* (2013.01); *F01C 3/025* (2013.01); *F01C 21/08* (2013.01)

(58) Field of Classification Search
CPC .. F01C 3/02; F01C 3/025; F01C 19/02; F01C 21/08; F02B 53/00; F02B 55/02
See application file for complete search history.

(56) References Cited

U.S. PATENT DOCUMENTS 1,037,655 A 9/1912 Peigler
2,090,280 A * 8/1937 Biermann ..... F04C 18/52 418/218

(Continued)

FOREIGN PATENT DOCUMENTS

DE 1553050 A1 12/1969
DE 2641451 3/1978

(Continued)

OTHER PUBLICATIONS

"International Search Report" and "Written Opinion" of the International Search Authority (ISA/EP) in LONTRA LIMITED, International Patent Application Serial No. PCT/GB2017/052557, dated Nov. 8, 2017 (10 pages).

(Continued)

*Primary Examiner* — Theresa Trieu
(74) *Attorney, Agent, or Firm* — Tillman Wright, PLLC; James D. Wright; David R. Higgins

(57) ABSTRACT

A rotary piston and cylinder device (1) comprising a rotor (2), a stator (4) and a rotatable shutter (3), a rotary piston and cylinder device comprising a rotor, a rotatable shutter, the rotor comprising a piston (5), the piston comprising a first side (5*b*) and a second side (5*a*), the first side (5*b*) arranged to seal with a slot of the shutter, and comprises a working face, the second side being a substantially oppositely directed side to the first side, and the second side (5*a*) comprising a sealing portion arranged to seal with the shutter slot and/or stator and a non-sealing portion arranged not to seal with the shutter slot.

19 Claims, 22 Drawing Sheets

(51) Int. Cl.

| | |
|---|---|
| ***F03C 4/00*** | (2006.01) |
| ***F04C 2/00*** | (2006.01) |
| ***F01C 19/02*** | (2006.01) |
| ***F01C 3/02*** | (2006.01) |
| ***F01C 21/08*** | (2006.01) |

(56) References Cited

U.S. PATENT DOCUMENTS

| | | | | |
|---|---|---|---|---|
| 2,411,707 | A | 11/1946 | Biermann | |
| 3,739,754 | A * | 6/1973 | Nutku | F01C 3/02 418/195 |
| 4,329,308 | A | 5/1982 | Langer et al. | |
| 4,391,574 | A | 7/1983 | Medel, Jr. et al. | |
| 7,080,976 | B2 | 7/2006 | Didin | |
| 8,152,504 | B2 | 4/2012 | Didin et al. | |
| 10,400,601 | B2 | 9/2019 | Lindsey | |
| 10,662,775 | B2 | 5/2020 | Lindsey | |
| 10,961,849 | B2 | 3/2021 | Lindsey | |
| 2009/0185925 | A1 * | 7/2009 | Didin | F01C 3/06 418/68 |
| 2017/0211387 | A1 * | 7/2017 | Lindsey | F01C 3/025 |
| 2017/0211388 | A1 * | 7/2017 | Lindsey | F01C 3/025 |
| 2017/0211389 | A1 * | 7/2017 | Lindsey | F01C 3/025 |

FOREIGN PATENT DOCUMENTS

| | | | |
|---|---|---|---|
| DE | 3146782 | A1 | 11/1981 |
| EP | 0933500 | A1 | 8/1999 |
| EP | 1441106 | A1 | 7/2004 |
| EP | 1793080 | A1 | 6/2007 |
| GB | 1068067 | A | 5/1967 |
| GB | 2528508 | A | 1/2016 |
| WO | 9114859 | A1 | 10/1991 |
| WO | 2007093818 | A2 | 8/2007 |
| WO | 2010023487 | A2 | 3/2010 |
| WO | 2018042195 | A1 | 3/2018 |

OTHER PUBLICATIONS

"International Search Report" and "Written Opinion of the International Search Authority" (European Patent Office) in Lontra Limited, International Patent Application Serial No. PCT/GB 2015052150, dated Oct. 26, 2015 (11 pages).

"International Search Report" and "Written Opinion of the International Search Authority" (European Patent Office) in Lontra Limted, International Patent Application Serial No. PCT/GB 2015052149, dated Nov. 6, (11 pages).

"International Search Report" and "Written Opinion of the International Search Authority" (European Patent Office) in Lontra Limiied, International Patent Application Serial No. PCT/GB 2015052145, dated Nov. 9, 2015 (10 pages).

"GB Search Report" GB Patent Application No. 1413170.0 for Lontra Limited, dated Feb. 19, 2015 (2 pages).

"GB Search Report" GB Patent Application No. 1413172.6 for Lontra Limited, dated Feb. 20, 2015 (2 pages).

"GB Search Report" GB Patent Application No. 1413174.2 for Lontra Limited, dated Feb. 19, 2015 (1 page).

* cited by examiner

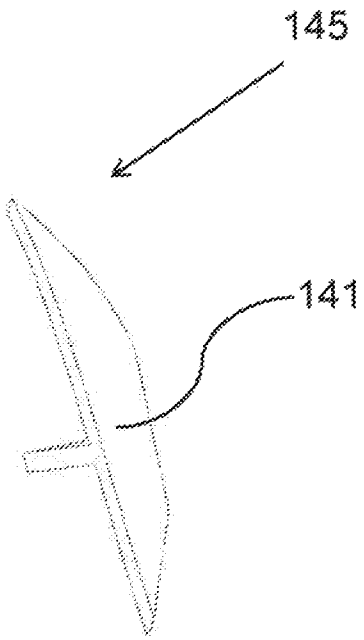
Figure 17b
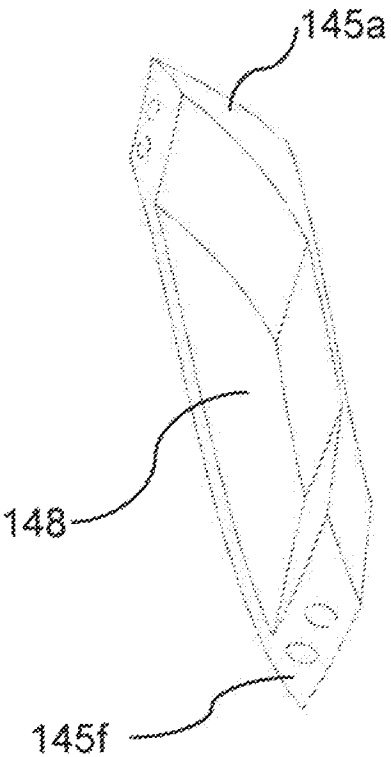
Figure 17a
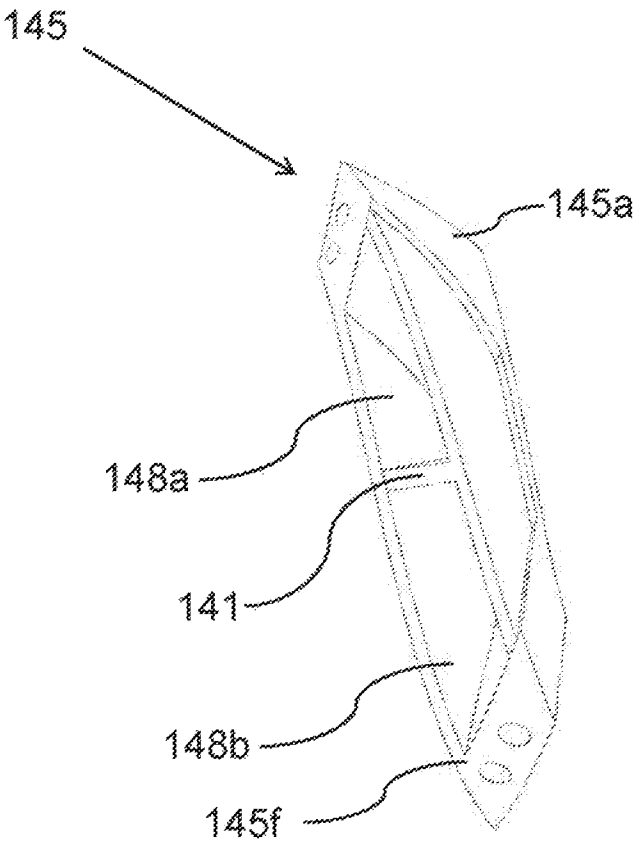

ROTARY PISTON AND CYLINDER DEVICE

CROSS REFERENCE TO RELATED APPLICATIONS

This application is the U.S. national stage application under 35 U.S.C. § 371 of co-pending International Application No. PCT/GB2017/052557, filed Sep. 1, 2017 and designating the U.S., which published as WO 2018/042195 A1 on Mar. 8, 2018, and which claims the benefit of United Kingdom Patent Application No. GB 1614976.7, filed Sep. 2, 2016. Each of the foregoing patent applications and patent application publications is expressly incorporated by reference herein in its entirety.

TECHNICAL FIELD

The present invention relates generally to rotary piston and cylinder devices

BACKGROUND

Rotary piston and cylinder devices can take various forms and be used for numerous applications, such as an internal combustion engine, a compressor such as a supercharger or fluid pump, an expander such as a steam engine or turbine replacement, or as another form of positive displacement device.

A rotary piston and cylinder device may be considered to comprise a rotor and a stator, the stator at least partially defining an annular chamber or cylinder space, the rotor may be in the form of a ring or annular (concave in section) surface, and the rotor comprising at least one piston which extends from the rotor into the annular cylinder space, in use the at least one piston is moved circumferentially through the annular cylinder space on rotation of the rotor relative to the stator, the rotor being sealed relative to the stator, and the device further comprising a cylinder space shutter which is capable of being moved relative to the stator to a closed position in which the shutter partitions the annular cylinder space, and to an open position in which the shutter permits passage of the at least one piston, such as by the shutter being rotatably mounted, the cylinder space shutter may be in the form of a shutter disc.

We have devised an improved piston for such devices.

SUMMARY

According to the invention there is provided a rotary piston and cylinder device comprising a rotor, a rotatable shutter, the rotor comprising a piston, the piston comprising a first side and a second side, the first side arranged to seal with a slot of the shutter and comprising a working face of the piston, the second side may be a substantially oppositely directed side to the first side, and the second side may comprise a sealing portion arranged to seal with the shutter slot and/or stator and a non-sealing portion arranged not to seal with the shutter slot and/or stator.

The sealing portion of the second side may comprise a distal surface portion which is arranged to seal with a surface of the shutter slot, or a surface of the stator, or a combination of both.

In this context, of a seal between the piston and the respective stator chamber-defining surfaces, and between the piston and the slot-defining surfaces of the shutter, reference to a seal includes allowance for an intentional leak path of fluid, by way of a close-spacing between opposed surfaces, and not necessarily forming a fluid-tight formation. Within this scope a seal may be achieved by way of close-running surfaces or a close-running line or a close-running region. The seal may be provided by a sealing gap between opposing surfaces, to minimise or restrict transmission of fluid therethrough. The sealing gaps corresponding to different surfaces may have varying clearances to their respective opposing parts, due to different assembly and operational requirements.

The non-sealing portion may comprise a surface which is spaced from or set back from, the sealing portion and the sealing portion may comprise a distal region of said second side.

The second side or a portion of the second side may be viewed as having augmented clearance relative to the shutter slot.

The non-sealing portion of the second side is substantially devoid of a sealing or close-running surface, with respect to a surface of the slot of the shutter. The non-sealing portion may be sufficiently spaced from an opposed surface of the stator/shutter slot so as not to seal or form a close-running line of region. The non-sealing portion may be viewed as being (at least in part) offset from a geometrically ideal position or configuration (for effecting a seal). The offset may generally be towards the first side. The offset may be uniform, or may be uneven or non-uniform across the offset area.

The second side may be termed the reverse side. Depending on the application for which the device is used, the working face and the reverse face may be the leading face and the trailing face respectively, or vice versa.

The first side and the second side may occupy respectively opposing parts of the piston, thus positioned along the sense of rotation of the rotor.

The first and second sides may be considered as comprising distal side portions.

The piston may be at least in part hollow. A substantial volumetric portion of the second side portion may be hollow, or comprise one or more voids or recesses. The first side portion may also be hollow.

The distal region of the second side may provide an opening into a space internal of the piston. The non-sealing portion may provide or be an opening to a region internal of the piston.

The distal region of the second side may comprise a margin or periphery to an opening or void or space, which distal region comprises a surface. The surface has appreciable surface dimensions, and may exclude reference to an edge, or sharp/discernible corner, or a portion of substantially negligible surface area or surface width/size.

The second side may be an open-ended side portion.

The second side portion may be substantially devoid of a major reverse surface or face.

An internal volume of the piston may include an insert which is formed of a different material to the major portion of the piston. The insert may be as structural insert.

The term 'piston' is used herein in its widest sense to include, where the context admits, a partition capable of moving relative to a cylinder wall, and such partition need not generally be of substantial thickness in the direction of relative movement but can be in the form of a blade. The partition may be of substantial thickness or may be hollow.

The piston may form a partition within the cylinder space. The piston may be arranged to rotate, in use, around the axis of rotation of the rotor.

Although in theory the shutter could be reciprocable, it is preferred to avoid the use of reciprocating components, particularly when high speeds are required, and the shutter preferably comprises one or more shutter discs which is arranged to be positioned substantially in register with the circumferentially- or circularly-extending bore of the annular cylinder space, and is provided with at least one aperture which in the open condition of the shutter permits passage of the at least one piston therethrough.

The rotor and stator may define a working chamber. A surface of the rotor which in part defines the working chamber may be concave or curved in cross-section. The working chamber may be of substantially annular form.

The shutter may present a partition which extends substantially radially of the cylinder space.

The at least one aperture of the shutter may be provided substantially radially in, and with respect to, the shutter.

Preferably the axis of rotation of the rotor is non-parallel to the axis of rotation of the shutter. Most preferably the axis of rotation of the rotor is substantially orthogonal to the axis of rotation of the shutter.

Preferably the piston is so shaped that it will pass through an aperture in the moving shutter, without balking, as the aperture passes through the annular cylinder space. The piston may be shaped so that there is minimal clearance between the piston and the aperture in the shutter, such that a seal is formed as the piston passes through the aperture. A seal may be provided on a surface or edge region of the first side portion of the piston. In the case of a compressor the first side portion provides a leading surface and in the case of an expander the first side portion provides a trailing surface. In either case, the first side portion comprises the working face of the piston, which is the face that imparts substantial work on- or has work imparted onto it by the working fluid.

The rotor may be rotatably supported by the stator rather than relying on co-operation between the piston and the cylinder walls to relatively position the rotor body and stator. It will be appreciated that a rotary piston and cylinder device is distinct from a conventional reciprocating piston device in which the piston is maintained coaxial with the cylinder by suitable piston rings or lands which give rise to relatively high friction forces.

The rotor may be rotatably supported by a suitable bearing carried by the stator or stator assembly.

The bearing may be located between parts that are joined or connected to either the rotor or the stator.

Preferably the stator comprises at least one or more ports. There may be at least one port for inlet flow, and at least one port for outlet flow.

At least one of the ports may be substantially adjacent to the shutter.

At least one of the ports may be positioned such as to form a valved port in cooperation with a port in the rotor.

Preferably the ratio of the angular velocity of the rotor to the angular velocity of the shutter disc is 1:1, although other ratios are possible.

The device may be of a type in which the chamber-defining rotor surface is directed or faces generally outwardly of the axis of rotation of the rotor. The device may also be of a type in which the chamber-defining rotor surface is directed or faces generally inwardly towards the axis of rotation of the rotor.

The shutter may be arranged to extend through or intersect the working chamber at (only) one region or location of the cylinder space.

The device, and any feature of the device, may comprise one or more structural or functional characteristics described in the description below and/or shown in the drawings.

BRIEF DESCRIPTION OF DRAWINGS

Various embodiments of the invention will now be described, by way of example only, with reference to the following drawings in which:

FIGS. 17*a* and 17*b* show perspective views of an embodiment of a piston.

DETAILED DESCRIPTION

Figure 1:
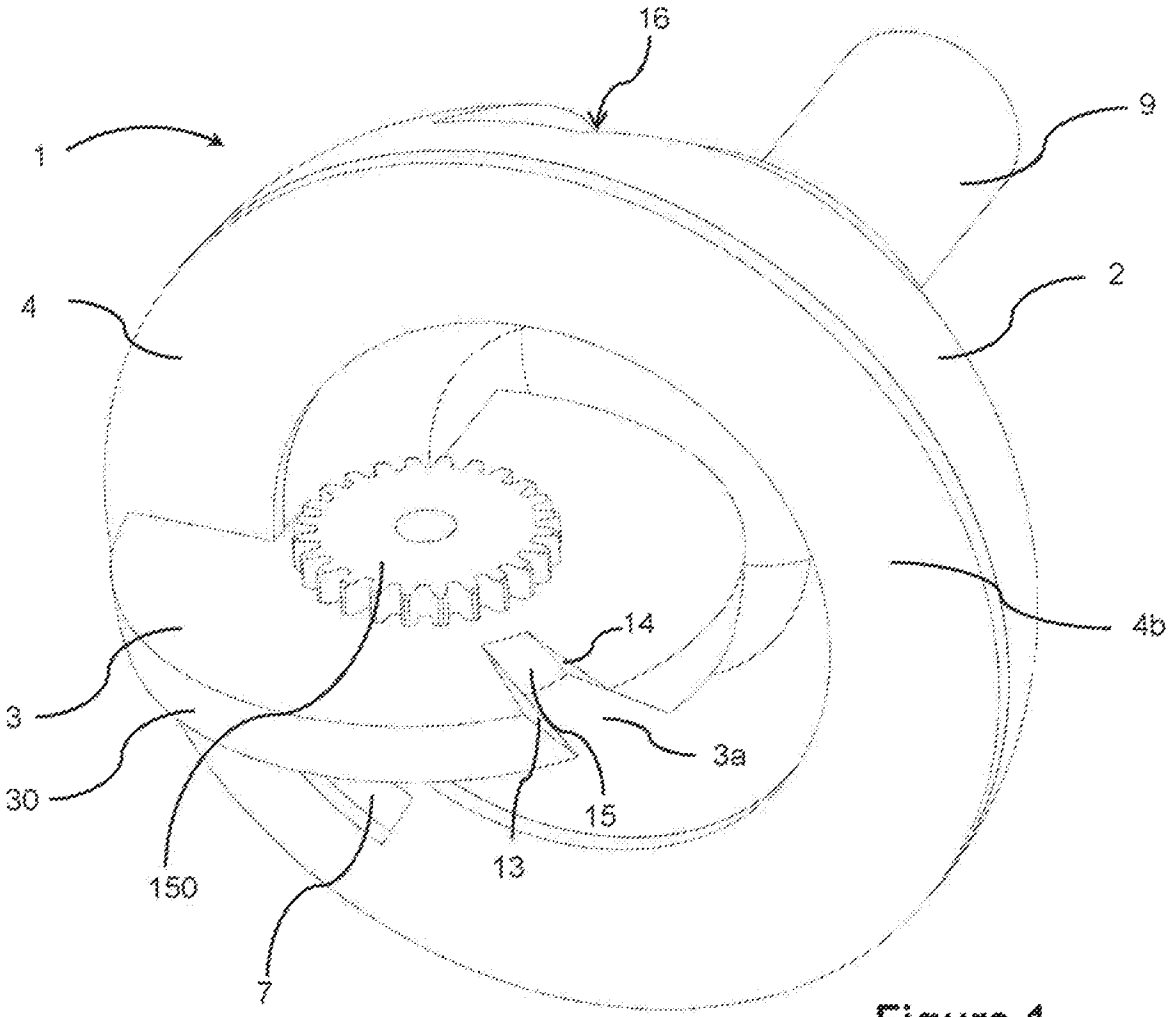
FIG. 1 is a perspective view of a rotary piston and cylinder device.
Figure 2:
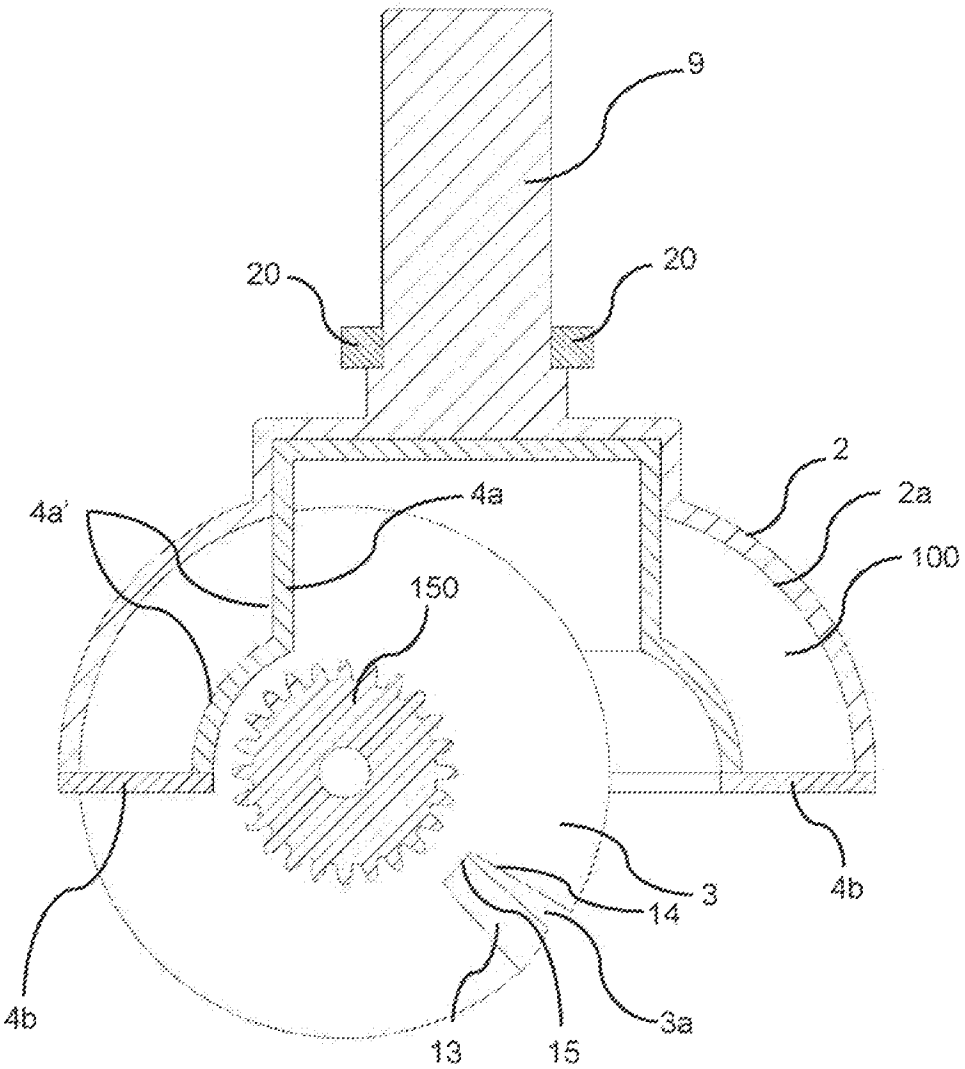
FIG. 2 is a cross-section of the device of FIG. 1, taken on a plane containing the rotational axis of the rotor.
Figure 3:
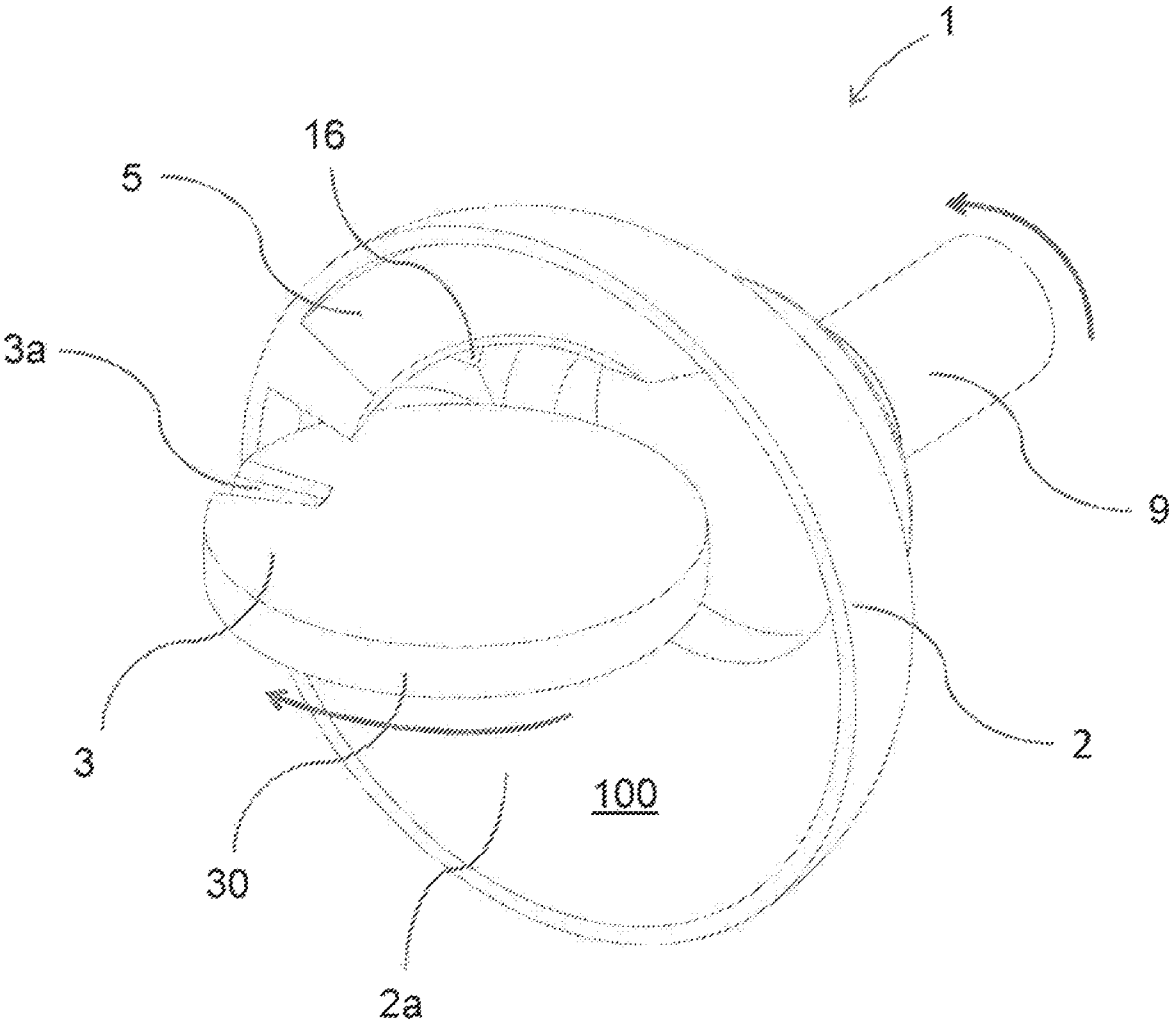
FIG. 3 is a perspective view of the device of FIG. 1, with the stator omitted.

Reference is made to FIGS. 1, 2 and 3, which show a rotary piston and cylinder device 1 which comprises a rotor 2, a stator 4, and a shutter disc 3, which can be can be configured for use in numerous operational guises.

The stator 4, although not shown in FIG. 3 for ease of representation, but shown in part in FIGS. 1 and 2, comprises a formation, such as a housing or casing, which is maintained relative to the rotor, and a surface of the stator facing the surface 2*a* of the rotor, together define an annular cylinder space or working chamber, shown generally as 100.

The stator 4 comprises what may be termed an inner stator and an outer stator. The inner stator 4*a* is of substantially cylindrical form and defines an outer surface 4*a*'. The outer stator 4*b* is of substantially annular form.

Integral with or fixed to the rotor and extending from the surface 2*a* there is provided a piston 5. A slot 3*a* provided in the shutter disc 3 is sized and shaped to allow passage of the piston therethrough, without baulking. Rotation of the shutter disc 3 is geared to the rotor by way of a transmission assembly. The transmission assembly synchronises the rotation of the rotor 2 and the shutter 3. The transmission assembly comprises a toothed gear 150. Further gears (not shown) or other transmission, such as comprising a gearbox, to connect the toothed gear to the shaft 9, which thereby ensures that the shutter 3 rotates in synchrony with the piston. It will be understood that different forms/types of transmission to synchronise the rotation of the shutter and the rotor and piston are possible.

The stator 4 further comprises a slot which is provided to receive the shutter 3, to divide the annular chamber, or cylinder space, 100 defined by the above mentioned surfaces of the rotor and the stator. A port 7 is provided in the outer stator 4*b*. Other ports may also be provided in the stator or in addition to the port 7.

In use of the device, a circumferential surface 30 of the shutter disc faces the surface 2*a* of the rotor so as to provide a seal therebetween, and so enable the shutter disc to functionally serve as a partition within the annular working chamber.

The geometry of the surface 2*a* of the rotor is governed by at least part of the circumferential surface of the rotating shutter disc. Since the shutter disc 3 penetrates/intersects only one side of the (annular) chamber, the axes of the disc and rotor will not generally intersect.

The shutter 3 comprises a shutter slot 3*a* to allow the piston 5 to pass therethrough. The slot 3*a* is defined by surfaces 13, 14 and 15

In the described embodiments which follow particular mention is made to the advantageous characteristics of the piston configuration.

With reference in particular to FIG. 3, the rotor 2 comprises a dished, concave (in cross-section on a radial plane which includes the axis of the rotor) surface. The rotor 2 fits over the inner stator 4*a* to define the annular cylinder space 100. The rotor 2 is provided with a fluid port 16. The port 16 can correspond with a further port in a further stator portion (not shown) on the opposite side of the rotor relative to the annular cylinder space, to form a valved port. In this embodiment such a stator portion will be substantially radially outward of the rotor. Alternatively, another form of valving or porting may be used.

In use, the shaft 9 is arranged to transmit torque to or from the rotor.

The piston 5 may be considered to have a first side and a second side, each of the sides occupying respective positions with respect to the sense of rotation, and can be considered as oppositely facing in that regard. In the context of this particular embodiment of rotary piston and cylinder device, each side portion may be considered either as a leading/forward part and a trailing/reverse part, respectively, occupying distal regions of the piston. In the embodiments which are described below, particular attention is given to what may be termed the reverse or non-working side portion of the piston, and its structure and configuration. Furthermore, in relation to the embodiments described below, the same reference numerals are used where the same or substantially the same feature, or equivalent feature (from either a functional and/or structural perspective) is referred to.

Figure 4B:
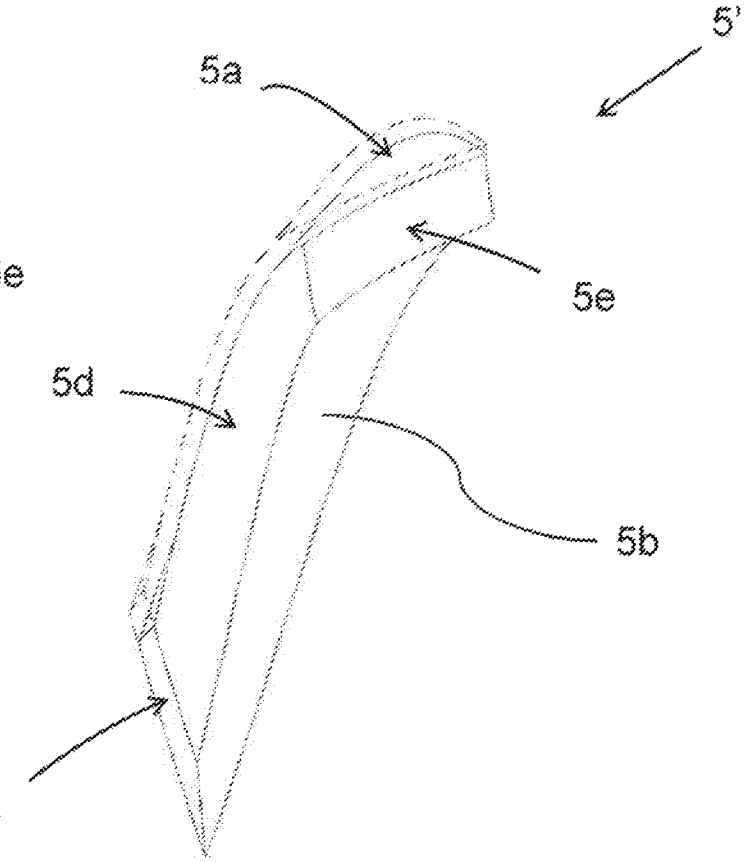
FIGS. 4*a* and 4*b* are perspective views of a rotor piston.
Figure 4A:
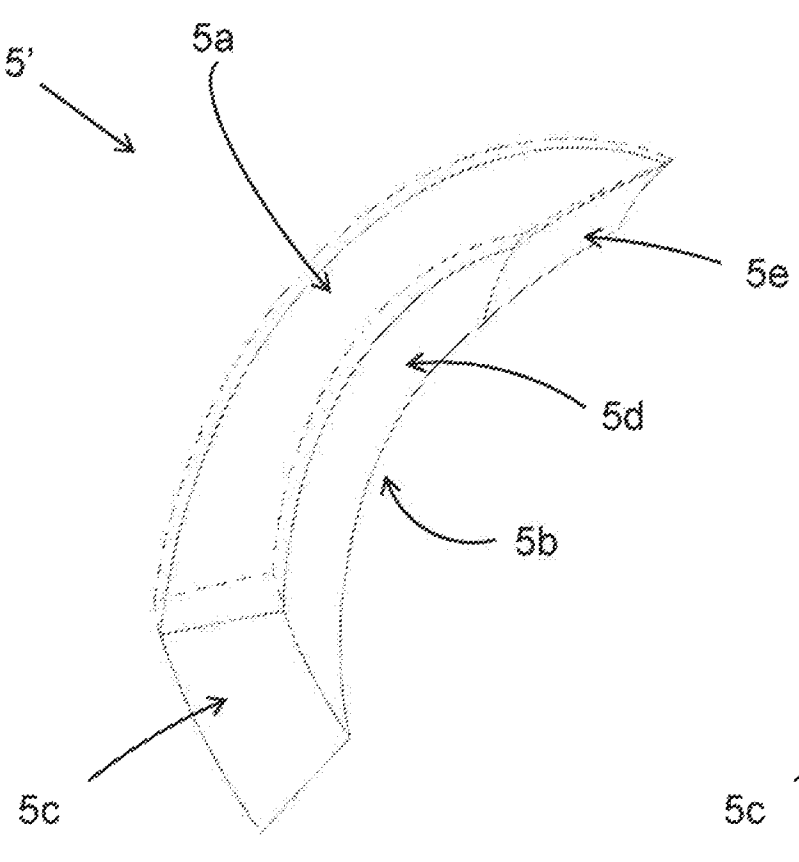

Reference is made to FIGS. 4*a* and 4*b* which shows a piston 5', in which the working side is referenced 5*b*, and the reverse side 5*a*. In order to better understand the characteristics of the embodiments described below, FIGS. 4*a* and 4*b* are used to demonstrate the geometry of the sides of the piston to either effect or avoid sealing with, or be relatively close-running to, the shutter slot. The broken line of the side 5*a* illustrates the extent and configuration of that side if it were arranged to seal with respective slot-defining surface of the aperture of the shutter 3. As is evident, the reverse side is offset from that sealing position, towards the working side 5*b*. This means that as the piston passes through the slot of the shutter, the reverse side would not seal with the respective surface of the shutter slot 3*a*. However, the working side 5*b*, when passing through the shutter slot, forms a seal with the respective surface of the slot.

The offset of the reverse side may often be required to prevent seizure of the piston inside the slot due to backlash (such as gear-tooth backlash or belt tension) of any transmission attached to the rotor, or to the shutter disc, or a transmission between the rotor and shutter disc.

Backlash in gears, for example, can be present only temporarily during vibrations or unloaded cycles, but if there is no allowance for relative motion between piston and shutter disc then seizure or damage may occur during these conditions. It is possible to simply arrange for larger clearances between piston and slot on both working and reverse faces of the piston, such that seizure could never occur, but this would mean that for the majority of operating conditions the clearance between the working face of the disc and the respective surface of the shutter disc slot would be much larger, increasing leakage and reducing performance. The embodiment shown in FIG. 4 is to arrange for extra clearance required to accommodate the backlash to be on the reverse face of the piston (by way of the offset surface 5*a*). This way, timing between piston and shutter disc can be set at one extreme of backlash (which should be the predominantly expected operational backlash) and in the case of backlash being present at some point, it can be taken up by this clearance.

By offsetting the entirety of face 5*a*, however, it can be seen that the sealing effect of faces 5*c*, 5*d*, 5*e* has been reduced due to the lower/shorter length, in the direction of piston motion, of their respective close-running lands. Since these faces are not likely to seize due to geartrain backlash like the opposing faces 5*a* and 5*b*, this reduction of sealing length does not have any counteracting benefit/effect.

In the embodiments which follow, we have devised a way to maintain the long sealing lands of faces 5*c*, 5*d* and 5*e* (or any equivalently positioned surfaces), while at the same time reducing the likelihood of seizure between shutter disc and piston. This is achieved by having a greater extent of some or all of the distal regions of 5*a*, compared to the central region(s) of 5*a*. By central we include the region inwardly at least in part surrounding a marginal portion. The distal regions can preferably be those which are situated close to the perimeter or margin region of 5*a* along the sides that are not in contact with the rotor surface 2*a*. These regions are preferably those which are in close cooperation with the stator, and at a part of the cycle can be in close cooperation with the shutter slot.

One additional benefit of this arrangement is that since the offset in the central region of the reverse face can be significantly larger than the required amount to accommodate backlash (since sealing between this portion and the shutter slot may not be important), this surface can be manufactured to a lower tolerance (as long as the offset at a given point on the surface is greater than the sum of expected backlash and maximum tolerance variation) than previously possible, which can reduce manufacturing costs. This offset may also allow other features to be incorporated into the piston without further disadvantage in terms of sealing or increased leakage.

In all of the embodiments which are described below, at least a portion of the reverse side of the piston is configured not to seal with or run relatively close to the slot of the shutter for example by being formed as offset from its geometrically ideal position to do so, and a portion is arranged to run closer to the shutter slot with the further benefit that distal regions running closer to the shutter slot may also increase the length of at least part of the side regions or surfaces such as 5*c*, 5*d*, and 5*e* in the direction of travel of the piston to give potential sealing improvements.

Figure 5:
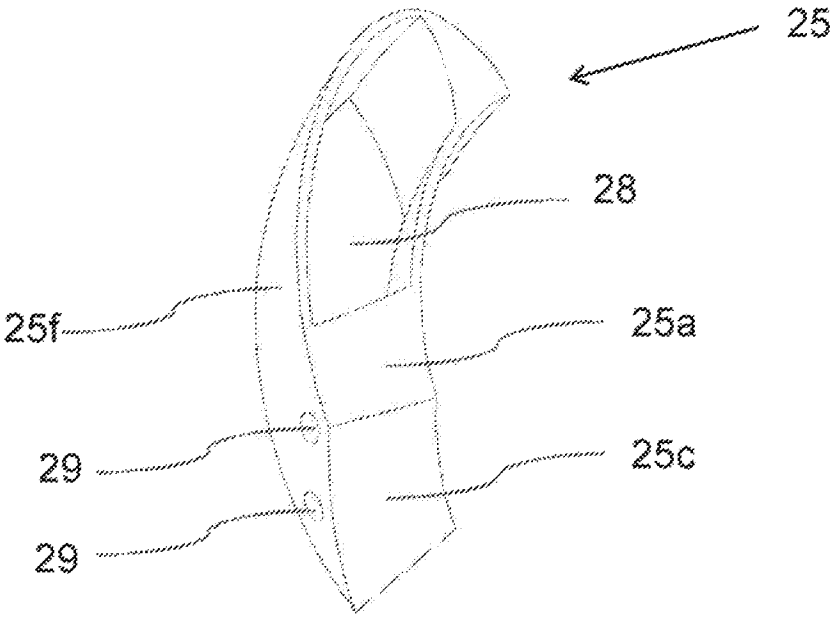
FIG. 5 is a perspective view of an embodiment of a piston.

Reference is made to FIG. 5 in which a piston 25 is shown which is in part hollow, extending from an opening on the reverse side surface 25*a*. A pocket or void 28 is defined which extends from the reverse side, into the volume of the piston. The piston 25 is also provided with location features 29, which are fastener location features, such as blind bores, which allow the piston 5 to be surely attached to the rotor surface 2*a*. Face 25*f* is the face of the piston that is substantially in cooperation with rotor face 2*a* once assembled. The pocketed reverse face (maintaining the greater extent around all its peripheral surfaces 25*c*, 25*d* and 25*e*), advantageously provides a wide surface 25*f* facilitating bonding or fixing the piston to the rotor. The reverse side surface 25*a* is arranged to run closer to the shutter slot, and effectively defines a periphery which bounds the opening to void 28. Clearly, the opening forms a non-sealing and non-close-running portion of the reverse side.

Figure 6:
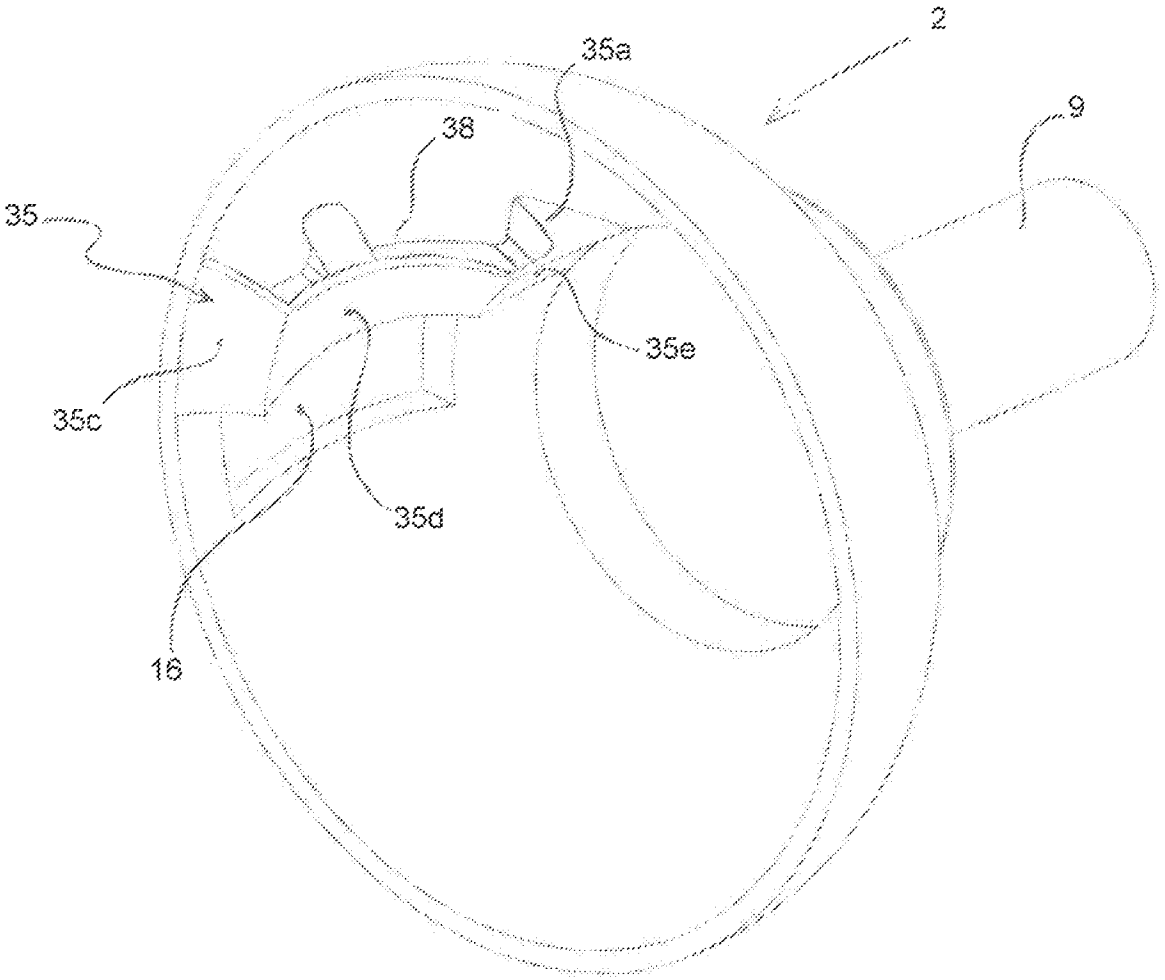
FIG. 6 is a perspective view of an embodiment of a rotor, which includes a further embodiment of a piston.

Turning to FIG. 6 this shows a rotor 2 which is provided with a variant hollow piston 35. As can be seen, the reverse side 35*a* is provided with an opening which extends into a void or hollow 38. The piston 35 further comprises surfaces 35*c*, 35*d* and 35*e*, which are arranged to seal, or preferably form a close-running arrangement, with respective surfaces of the inner and outer stator parts 4*a* and 4*b*. Similarly to FIG. 5, the reverse side surface 35*a* may seal or run relatively close to the shutter slot and the opening to the void 38 serves as a non-sealing portion. As with the previous and all following figures and embodiments it is understood that close running is a relative term when compared to other surfaces or regions and that a close running region or surface may still have substantial clearance to its opposing surface.

Figure 7B:
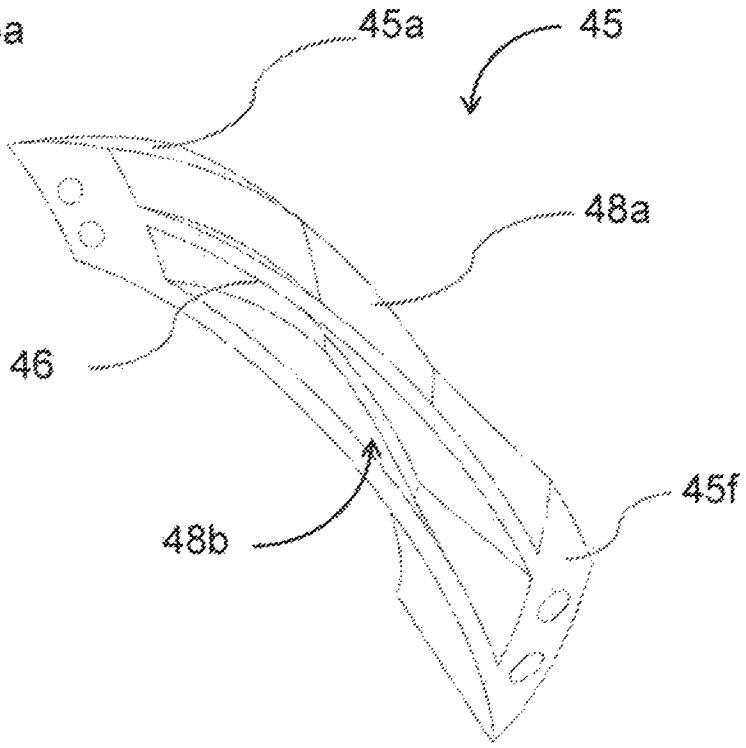
FIGS. 7*a* and 7*b* show perspective views of an embodiment of a piston.
Figure 7A:
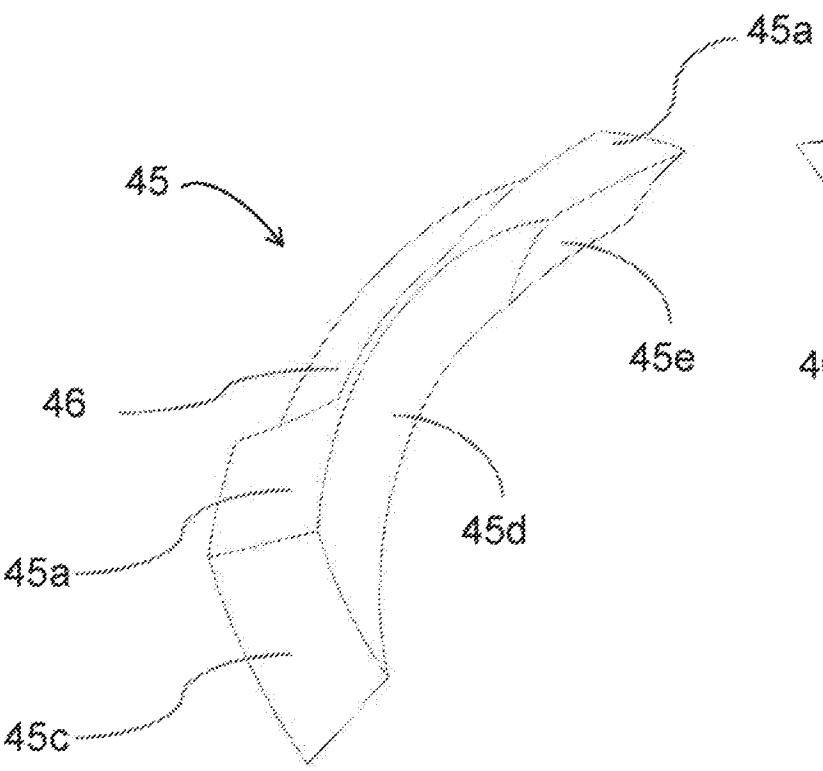

In FIGS. 7*a* and 7*b*, a piston 45 is shown which comprises a reverse face or side 45*a* and additional faces or surfaces 45*c*, 45*d*, 45*e*, 45*f*, and which further comprises a rib 46 which defines two sub-chambers or voids 48*a* and 48*b* within the spatial envelope of the piston. The rib 46 is offset inwards (i.e. towards the working face) by constant amount. It will be appreciated that the side surface of the rib 46 could be viewed as providing a stepped back surface of the reverse side, with respect of the distal or 'endmost' surface 45*a* of that side. A significant volumetric proportion of the piston being hollowed advantageously allows for mass reduction. Although in this embodiment the rib is offset inwards by a constant amount, other embodiments are possible where the parts of the rib are offset inwards by a variable amount. Further the voids 48*a* and 48*b* may be completely separated or may be arranged to communicate at one or more regions.

Figure 8B:
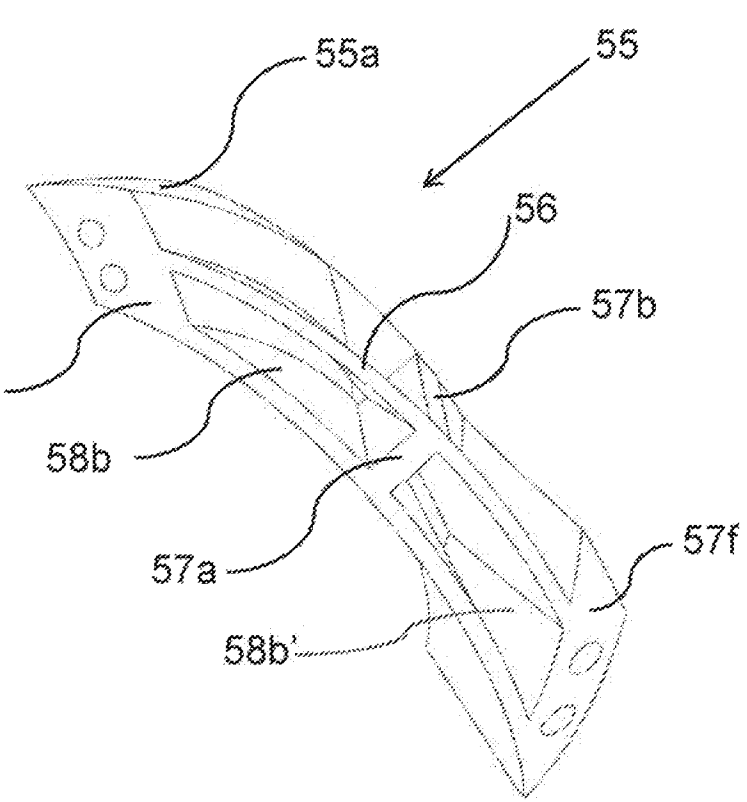
FIGS. 8*a* and 8*b* show perspective views of an embodiment of a piston.
Figure 8A:
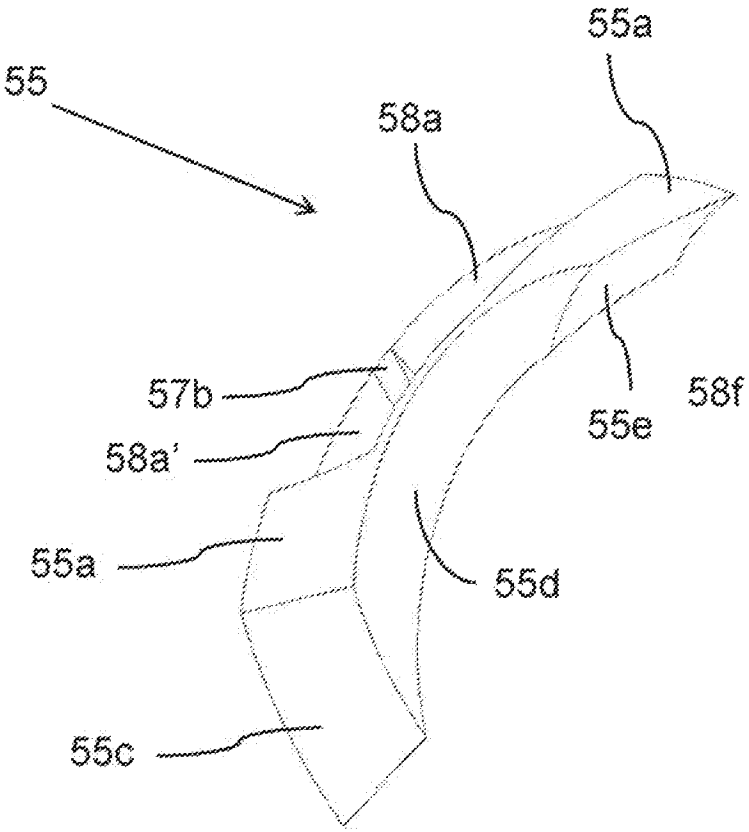

FIGS. 8*a* and 8*b* show a piston 55 which is somewhat similar to that shown in FIGS. 7*a* and 7*b*, with a reverse side surface 55*a* and additional faces or surfaces 55*c*, 55*d*, 55*e*, 57*f*, and the addition of ribs 57*a* and 57*b* to provide structural support, in particular to the surface 55*d*. The ribs and the rib 56, together define pockets or voids 58*a*, 58*a*', 58*b* and 58*b*' within the volume of the piston.

Figure 9B:
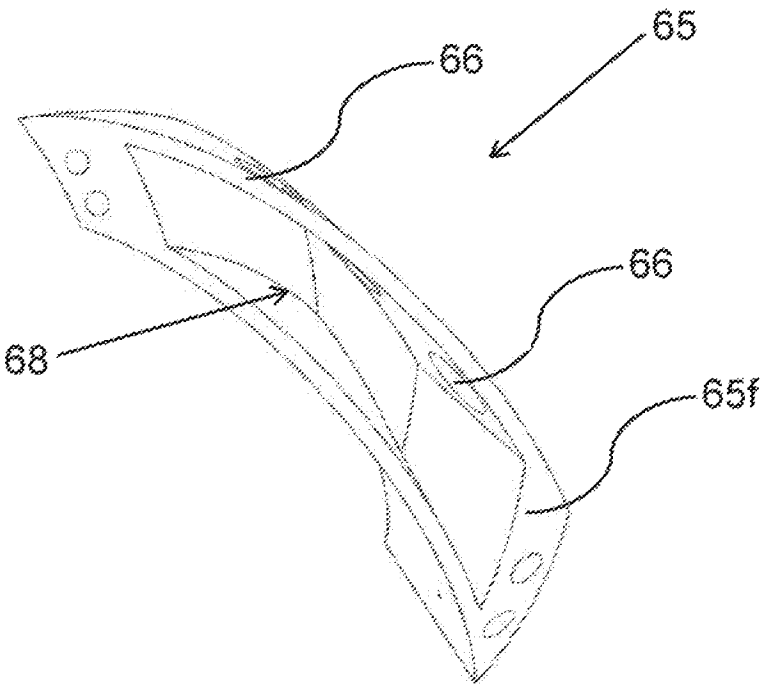
FIGS. 9*a* and 9*b* show perspective views of an embodiment of a piston.
Figure 9A:
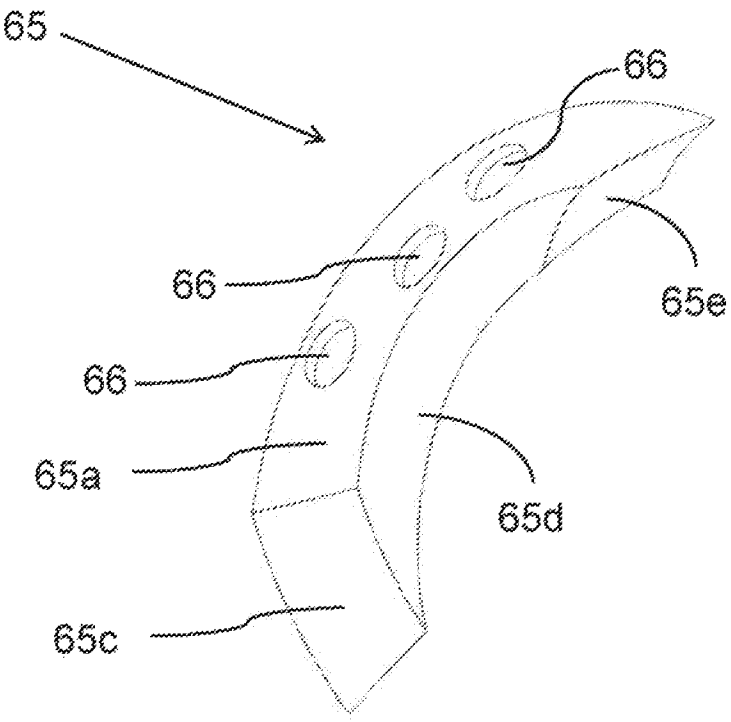

FIGS. 9*a* and 9*b* show a piston 65 having a reverse side sealing surface 65*a* and additional faces or surfaces 65*c*, 65*d*, 65*e*, 65*f*. The reverse side surface is provided with apertures 66, which are in communication with a hollow interior volume 68 of the piston. The apertures 66 can create a resonant cavity inside the piston, which results in control/absorption of pressure pulsations (noise) in the working chamber 100 of the device (the portion of chamber that is in communication with features 65*a* and 66 at a given time). The apertures may also provide a way of further reducing mass of a hollow piston, advantageously with minimal effect on strength/stiffness. Furthermore, the apertures may also increase heat transfer between fluids on either side of the piston. It will be appreciated that the shutter slot will not form a seal with the openings 66.

Figure 10B:
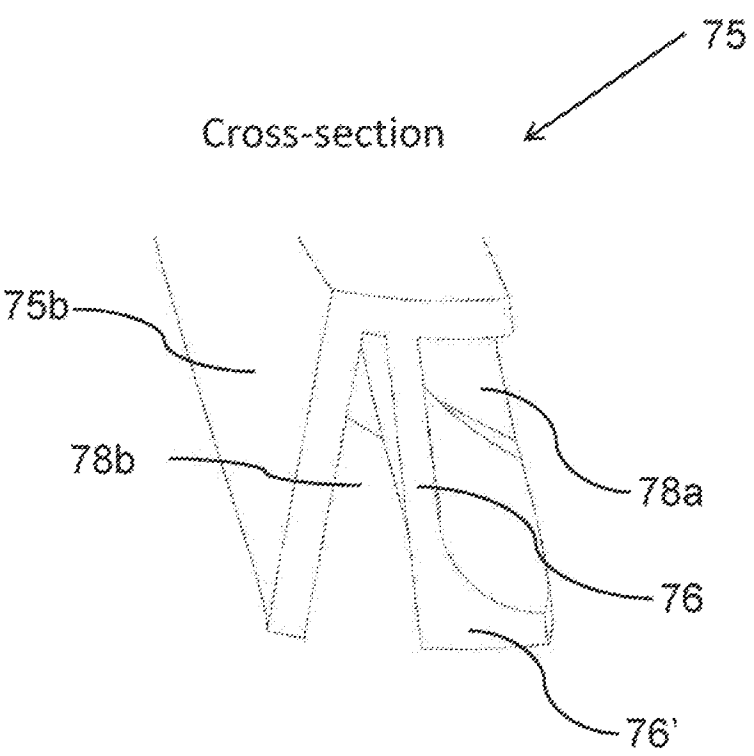
FIGS. 10*a* and 10*b* show a perspective and a cross-sectional view of an embodiment of a piston.
Figure 10A:
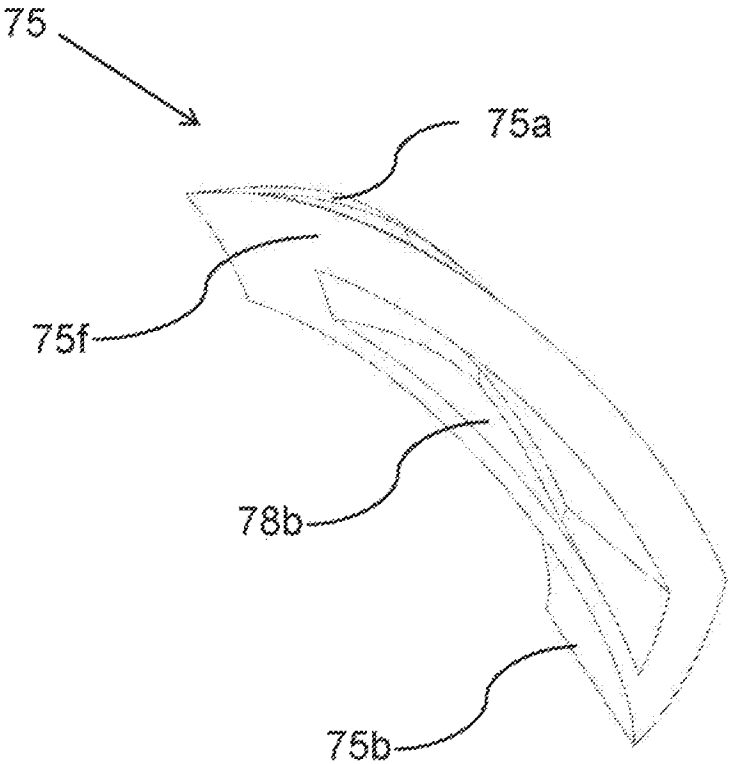

FIGS. 10*a* and 10*b* show a piston 75 which comprises a rearward sealing surface 75*a* and an additional face or surface 75*b*, and voids 78*a* and 78*b*, separated by partition 76. The rearward sealing surface 75*a* surrounds the opening to the void 78*a* and at that opening, sealing with the shutter does not occur. As can be seen in FIG. 10*b*, the surface 75*f* which faces rotor surface 2*a* once assembled, is formed partly by portion 76'. The provision of 76' advantageously provides a wide area to achieve a high degree of bonding strength if the piston is attached to the rotor by brazing or adhesives or other similarly bonding method (of the surface 75*f* to the surface 2*a* of the rotor) rather than by way of mechanical fasteners. It can be seen that in this manner, a wide bonding area has been achieved, while reducing the chance of seizure due to the absence of the majority of surface 75*a*. Compared to FIG. 5, a stiffer piston is achieved due to the presence of partition 76.

Figure 11B:
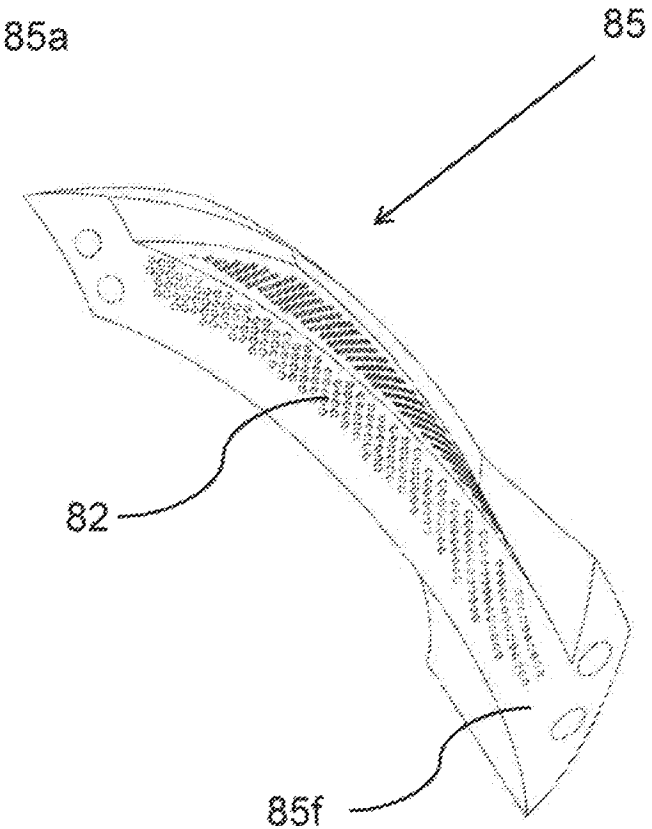
FIGS. 11*a* and 11*b* show perspective views of an embodiment of a piston.
Figure 11A:
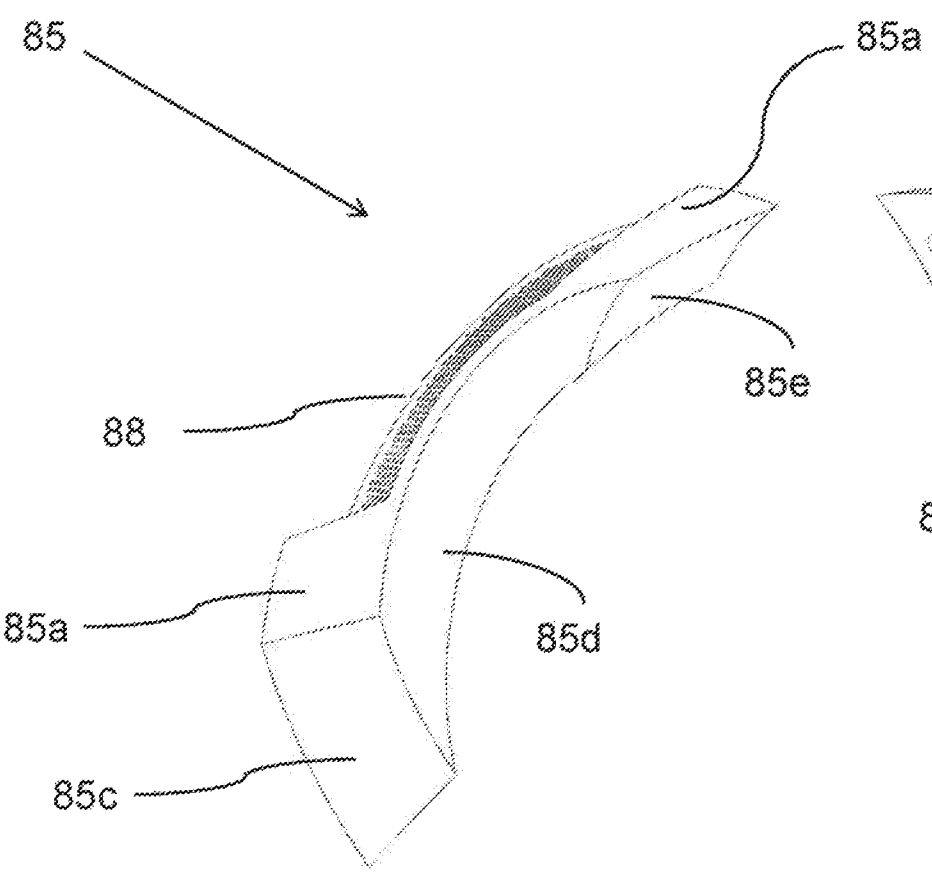

FIGS. 11*a* and 11*b* show a piston 85 with a porous (represented by a honeycomb-type structure here) interior 82. The porosity is shown to extend to the mounting face 85*f*. The piston 85 comprises reverse side surface 85*a* and additional faces or surfaces 85*c*, 85*d*, 85*e*. A 'cut-out' or recessed region 88 is provided adjacent to the porous interior portion and is set back or offset from the sealing surface 85*a*. This provides superior stiffness and lower mass compared to a hollow and solid piston respectively. The porosity features could be created by inserts into the casting, or purely by the casting method, or could be machined-in after casting. The porosity features need not be uniformly distributed. The porosity can be thought of as a further void within the piston.

Figure 12B:
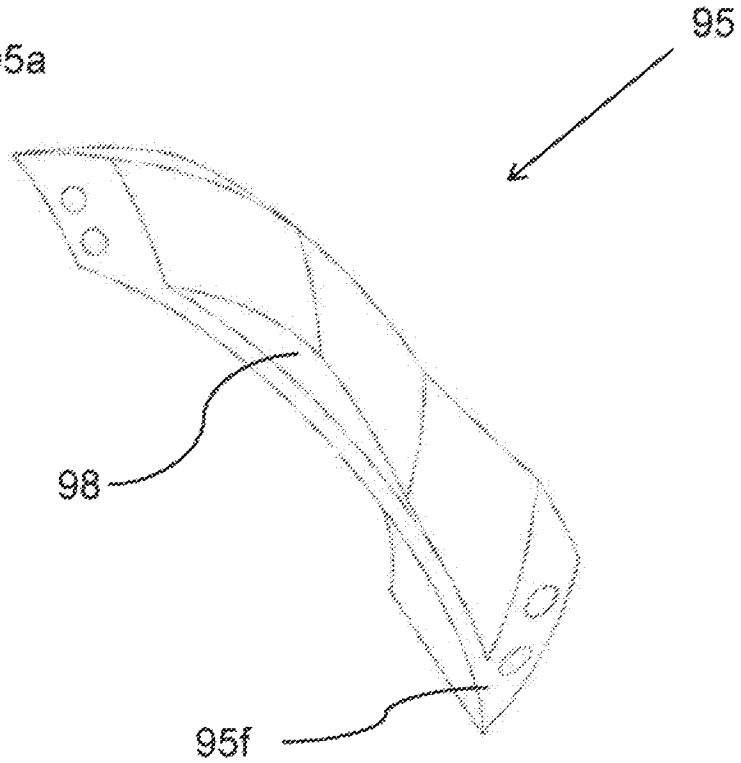
FIGS. 12*a* and 12*b* show perspective views of an embodiment of a piston.
Figure 12A:
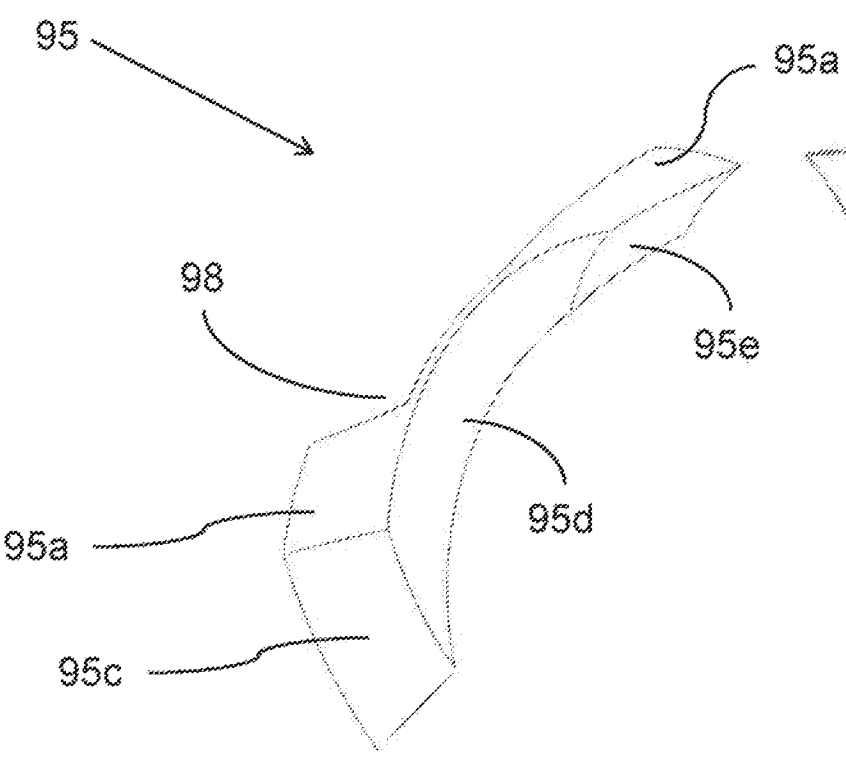

FIGS. 12*a* and 12*b* show a piston 95 which may be thought of as substantially devoid of a major reverse face with reverse surface 95*a* as well as additional faces or surfaces 95*c*, 95*d*, 95*e*, 95*f*, arranged to seal with or run relatively close to the shutter slot. This is best appreciated when comparing to the embodiment shown in FIGS. 7*a* and 7*b* in which the rib 46 is essentially omitted from this embodiment. The rearward surface of the rib provided an (offset) reverse surface of the piston. This, in the current embodiment, results in the creation of the large void 98. The piston 95 provides significant mass reduction and simplified machining.

Figure 13B:
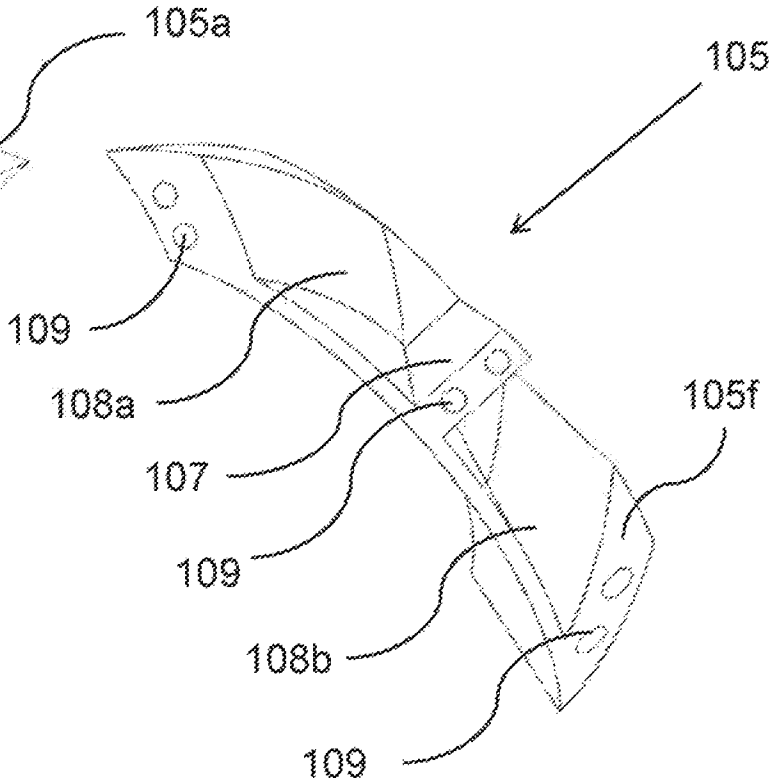
FIGS. 13*a* and 13*b* show perspective views of an embodiment of a piston.
Figure 13A:
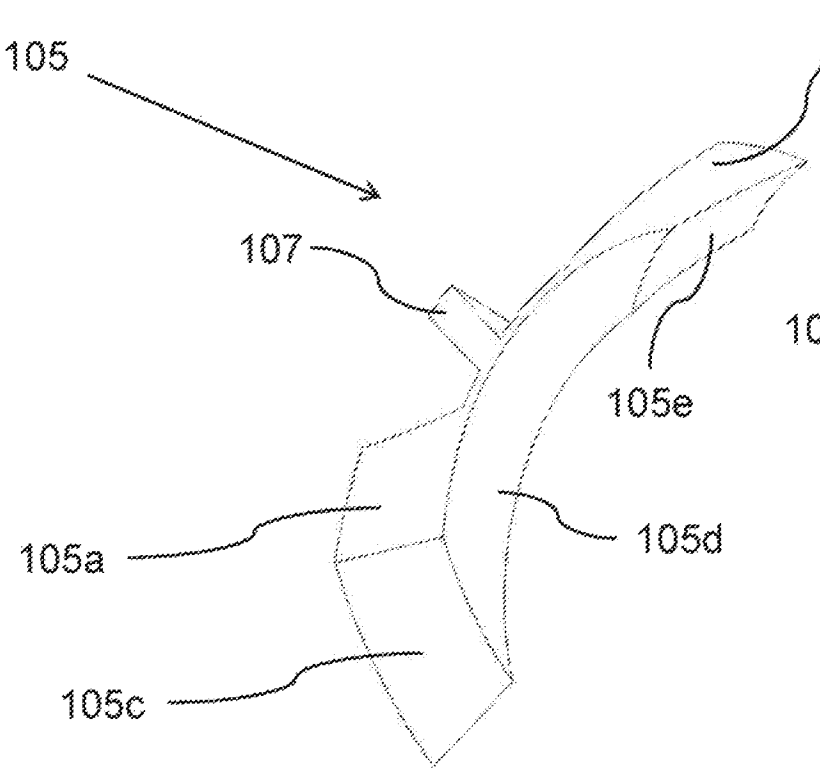

FIGS. 13*a* and 13*b* show a variant embodiment 105 of the piston shown in FIGS. 12*a* and 12*b* which comprises a structural rib 107 and reverse surface 105*a* as well as additional faces or surfaces 105*c*, 105*d*, 105*e*, 105*f*. The rib 107 assists in defining sub-chambers 108*a* and 108*b*. This increases stiffness of the piston, and provides additional space for additional location features 109, such as may be required when the piston subject to greater loading. This is just one example of a possible embodiment and in alternative embodiments further ribs or bosses may be employed.

Figure 14:
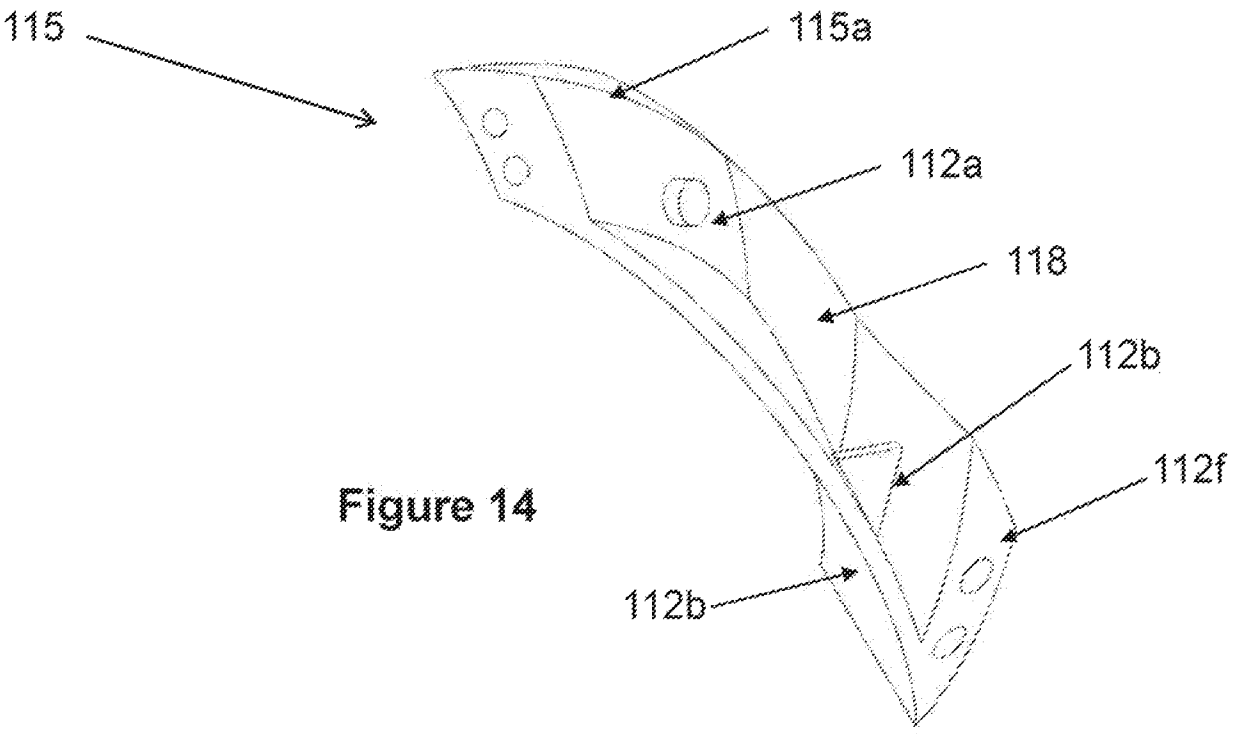
FIG. 14 shows a perspective view of an embodiment of a piston.

FIG. 14 shows a piston embodiment 115 which may be seen as a modified version of that shown in FIGS. 12*a* and 12*b*. The piston 115 includes a side surface 115*a* and further includes a mould gate 112*a* and rib 112*b* to help mould flow around the sharp change of direction, located within the hollow of the piston and which can be retained on the piston interior. Additionally, moulding by-products such as ejector pin recesses can be located on surfaces of a cavity inside the piston, and similarly do not need to be removed in further operations (which reduces cost and complexity of production) as they do not risk contacting a portion of the slot or stator. Alternatively, additional cast or machined features may be located within the hollow 118 of the piston to help mount the piston for manufacture or to form reference points or features for measurement of piston surfaces or regions.

Figure 15B:
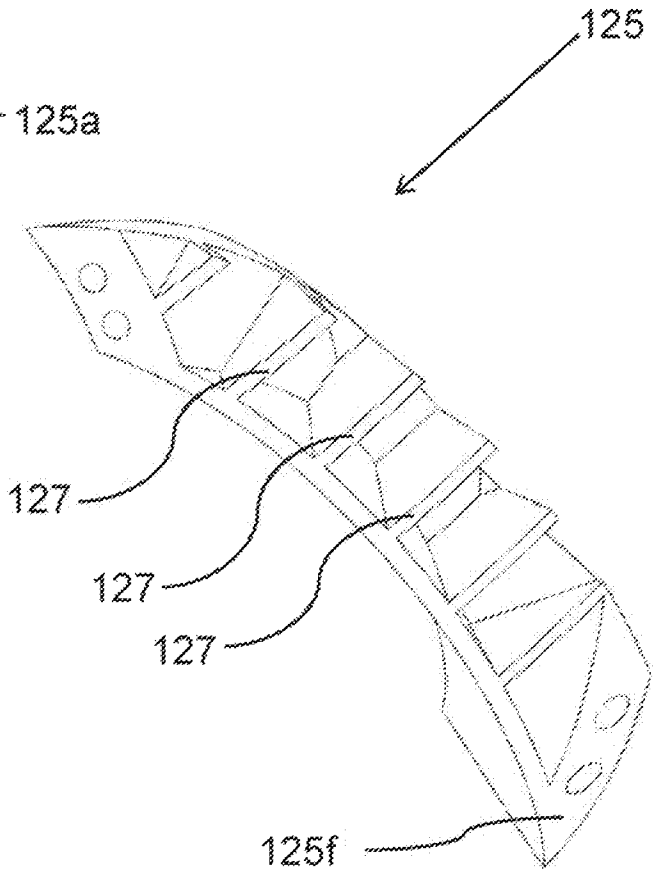
FIGS. 15*a* and 15*b* show perspective views of an embodiment of a piston.
Figure 15A:
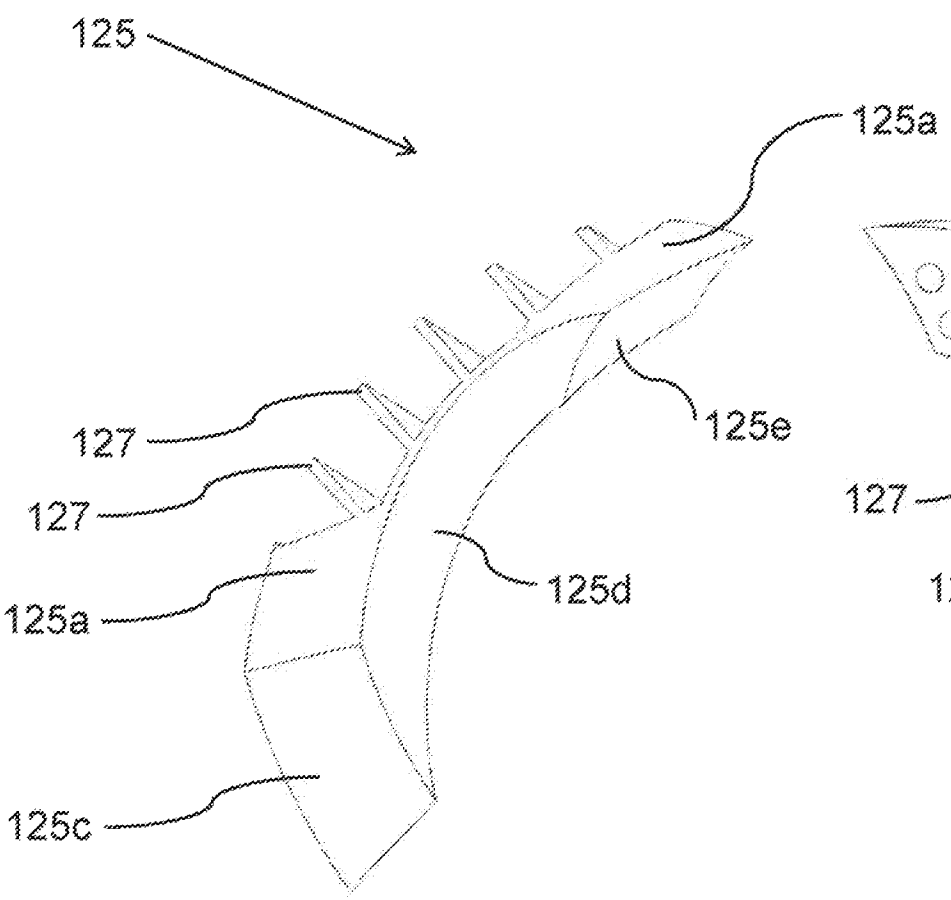

FIGS. 15*a* and 15*b* show a piston 125 which is provided with multiple spaced-apart fins 127. The distal reverse sealing side surface of the piston is shown by 125*a*, and the piston includes additional faces or surfaces 125*c*, 125*d*, 125*e*, 125*f*. The fins advantageously increase surface area for enhanced heat transfer between working fluid either side of the piston, through the piston. The fins can also have the effect of damping vibrations in chamber.

Figure 16B:
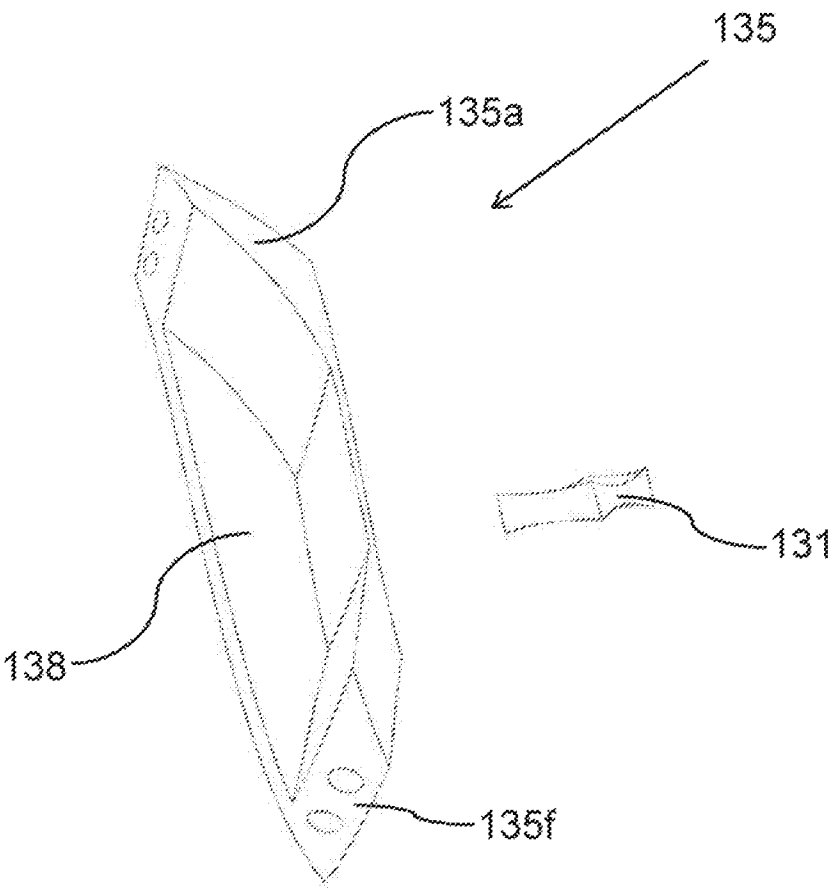
FIGS. 16*a* and 16*b* show perspective views of an embodiment of a piston.
Figure 16A:
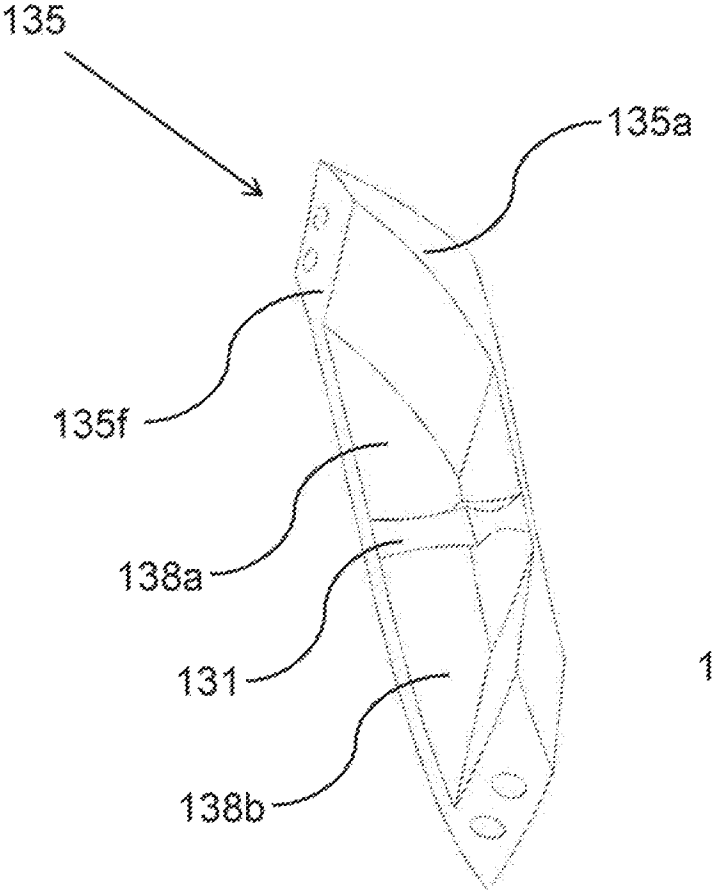

FIGS. 16*a* and 16*b* show a piston 135, having faces or surfaces 135*a*, 135*f*, and in which a space 138 defined by the piston includes a high-stiffness structural insert 131 located between faces 138*a* and 138*b*. The piston can cast from a lower grade metal or material, which is then stiffened with the insert. This can significantly reduce the complexity and cost of producing the piston in its entirety out of the stiffer material (which may be more expensive and complex to process). The insert could be attached using fasteners or bonded using brazing or adhesives. It is noted that one or more inserts could be used and that many alternative shapes or forms of insert could be employed.

FIGS. 17*a* and 17*b* show a similar concept in which the piston 145, having faces or surfaces 145*a*, 145*f*, comprises an insert 141 located in the space 148 located between faces 148*a* and 148*b*, and the insert includes a reverse facing surface. The insert could be made from cheap materials using low-tolerance methods such as injection moulded plastics, and could be used to provide an approximation to the geometrically-correct working face, at a lower mass and cost compared to the piston being made from the stiff material (e.g. metal) using a high-accuracy process throughout. The purpose of providing the insert could be to reduce the thermal transfer between the working fluid on either side of the piston. The reverse facing surface of insert 141 may be offset from surface 145*a* to give additional clearance to the disc slot.

Figures 18A, 18B:
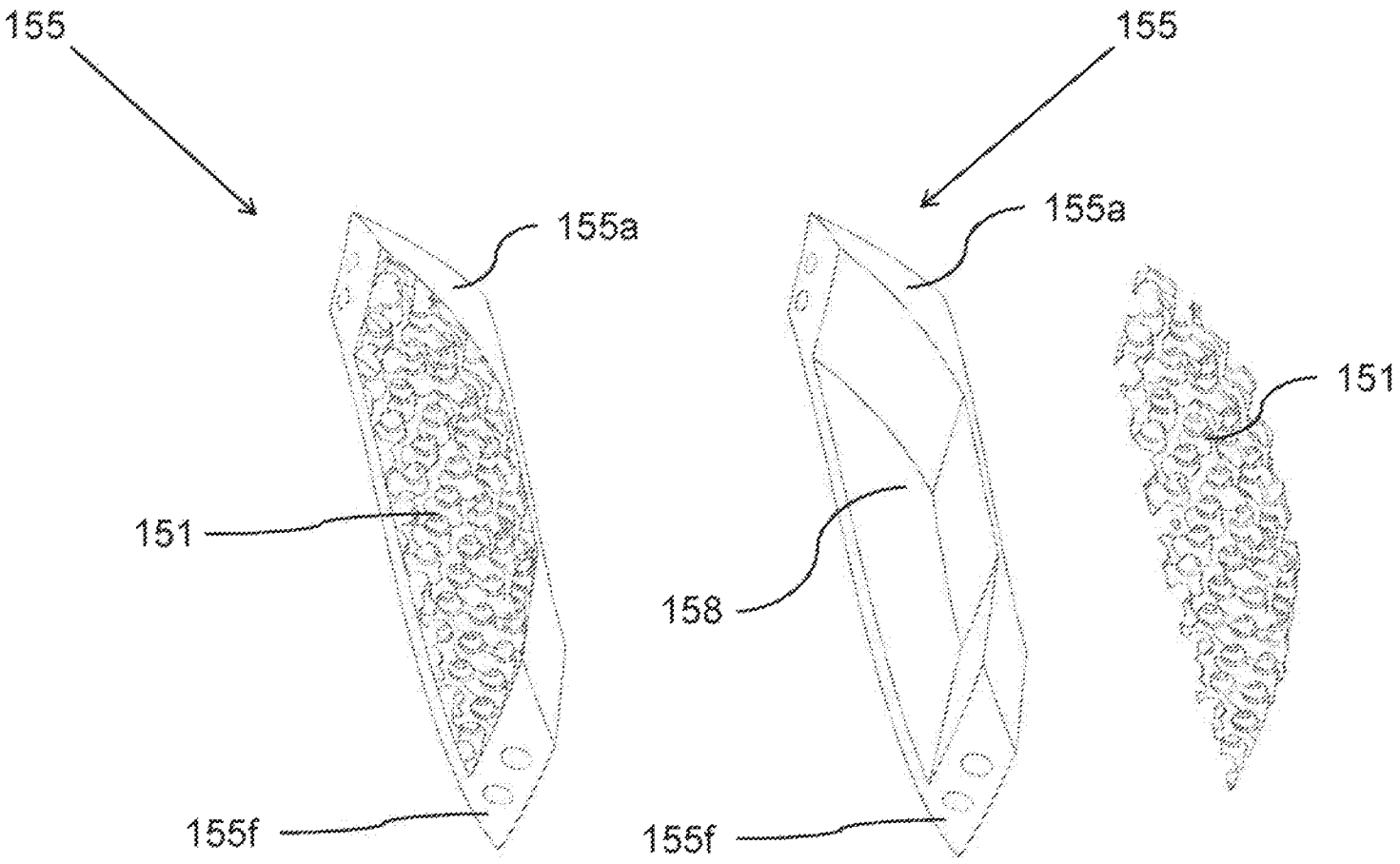
FIGS. 18*a* and 18*b* show perspective views of an embodiment of a piston.

FIGS. 18*a* and 18*b* show a further embodiment 155 along similar lines in which a honeycomb or porous insert 151 is attached into the space 158 defined internally of the piston. The insert may provide additional stiffness, or may be included solely for the purposes of reducing the volume of void 158, or for additional vibration absorption.

Figures 19A, 19B:
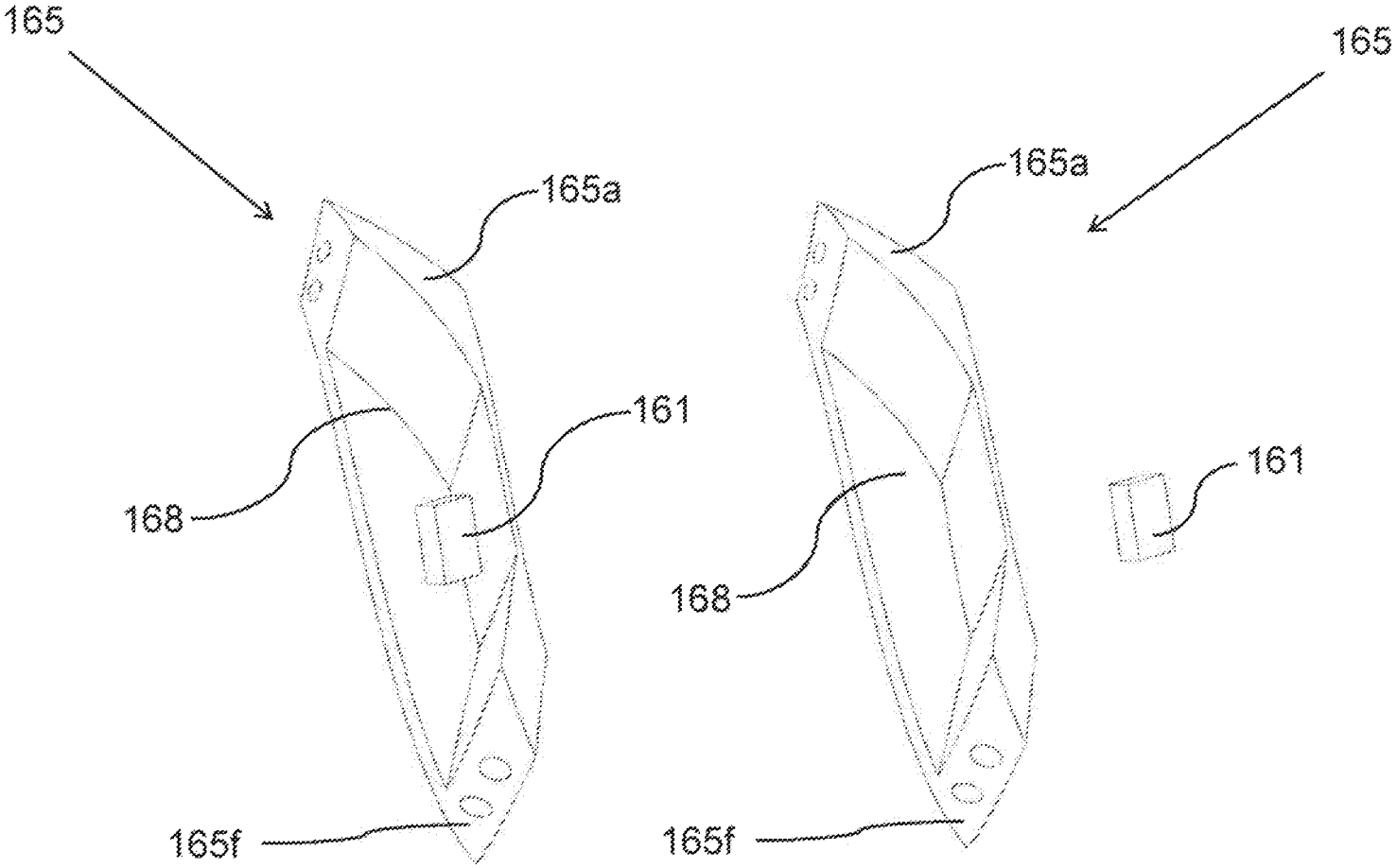
FIGS. 19*a* and 19*b* show perspective views of an embodiment of a piston.

FIGS. 19*a* and 19*b* show a piston embodiment 165, having faces or surfaces 165*a*, 165*f*, in which a sensor means 161 is included inside the hollow volume 168 of the piston. Since the reverse side portion of the piston is substantially open, the sensor will have access to the fluid in the chamber, and for example could be used to monitor pressure, temperature, humidity or contamination. The sensor could be a passive heat-sensitive paint that could be externally observed using a camera. The sensor could further be an active electronic module or device, which could be powered by a range of power sources such as a battery, inductive power transfer from external source, a thermal gradient across it, vibration, or another method. Other sensing means could also be used.

Figure 20B:
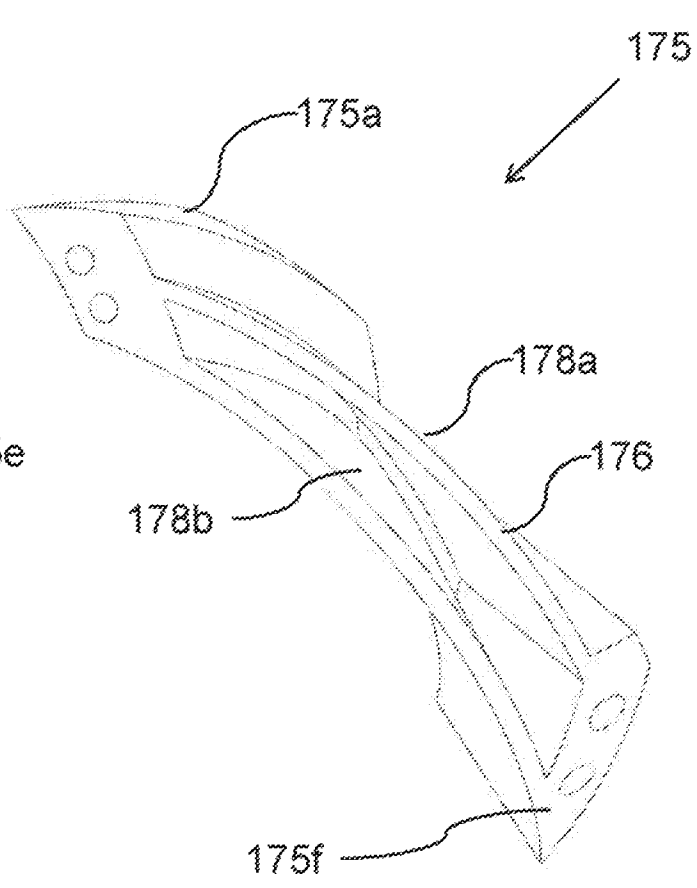
FIGS. 20*a* and 20*b* show perspective views of an embodiment of a piston.
Figure 20A:
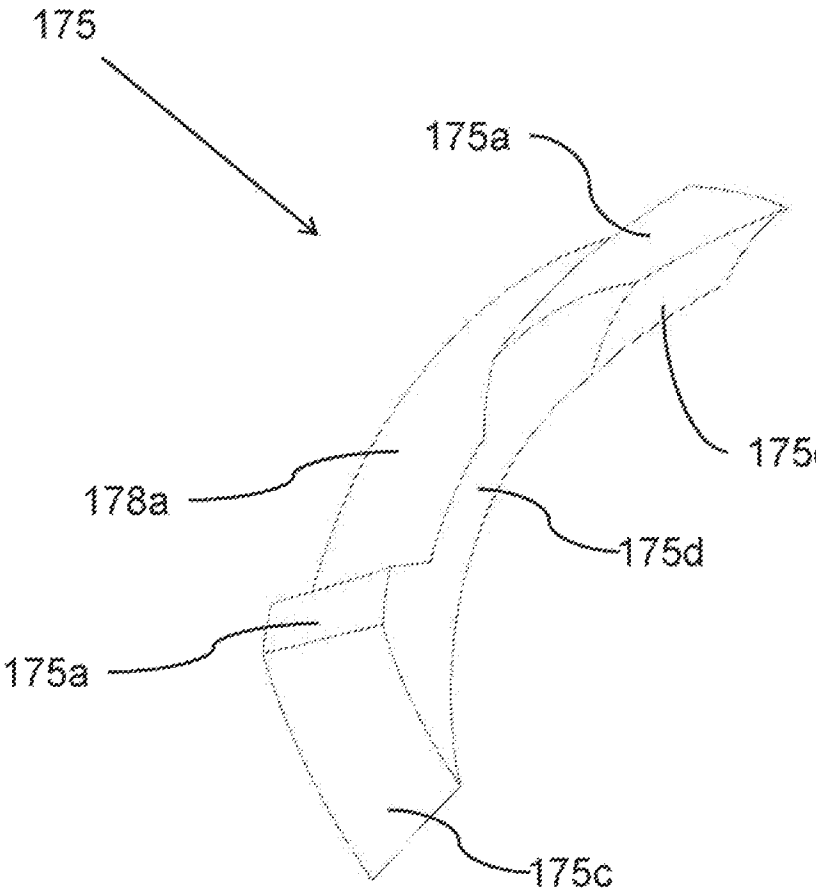

FIGS. 20*a* and 20*b* show piston 175, which can be considered a variation of piston 45 in FIGS. 7*a* and 7*b* and includes a rib 176 and voids 178*a* and 178*b*. In this case, a further part of the distal region of the rear surface 175*a* has been recessed or offset. Although the sealing effect across the resultant shorter surface 175*d* is reduced, its impact on this surface may be lower than of surfaces 175*c* and 175*e*. In this way further mass reductions can be possible while the sealing benefits on the full length surfaces 165*c* and 175*e* can still be utilised. In an alternative embodiment, further parts of the distal region of rear surface 175*a* could be recessed or offset which may reduce the sealing surfaces of part or all of 175*c* and or 175*e*.

Figures 21A, 21B:
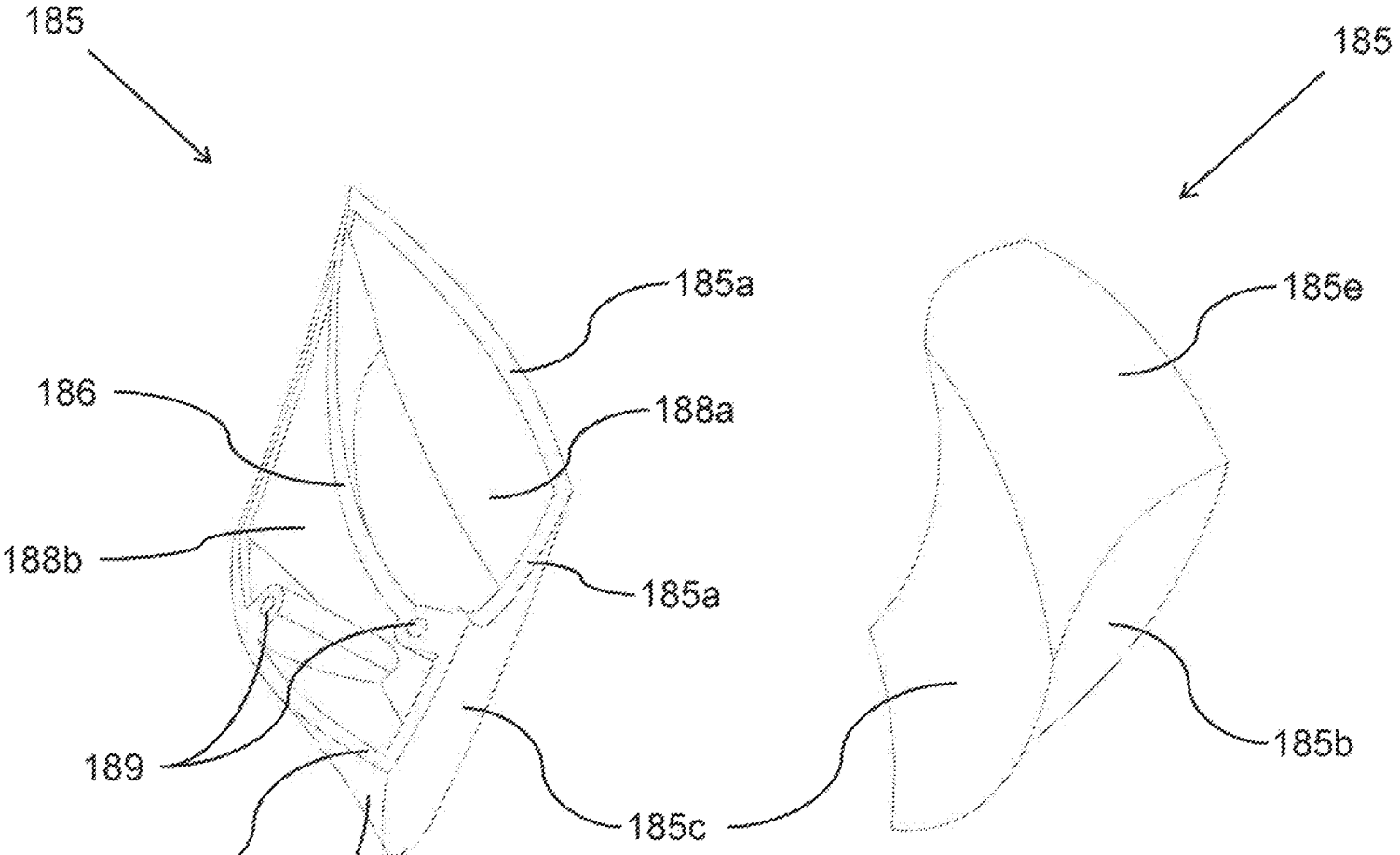
FIGS. 21*a* and 21*b* show perspective views of a piston of a further type of rotary piston and cylinder device.

FIGS. 21*a* and 21*b* show piston 185, having surfaces or faces 185*b*, 185*c*, 185*e* and 185*f*, from a further embodiment of a rotary piston and cylinder device. This is used to illustrate how the present invention can apply to such types of piston. Piston 185 has fewer external surfaces due to a different configuration of the shutter slot and inner stator. It will be seen that the second side portion can still be defined as being opposite to the working face 185*b* of the first side portion, comprising the distal surface region 185*a*. The rib 186 can be seen to represent a large non-uniform offset from the respective surface of the shutter, and is present to increase stiffness of the piston. Fastener locating features 189 are present to assist attachment of the piston to the rotor.

Figure 22A:
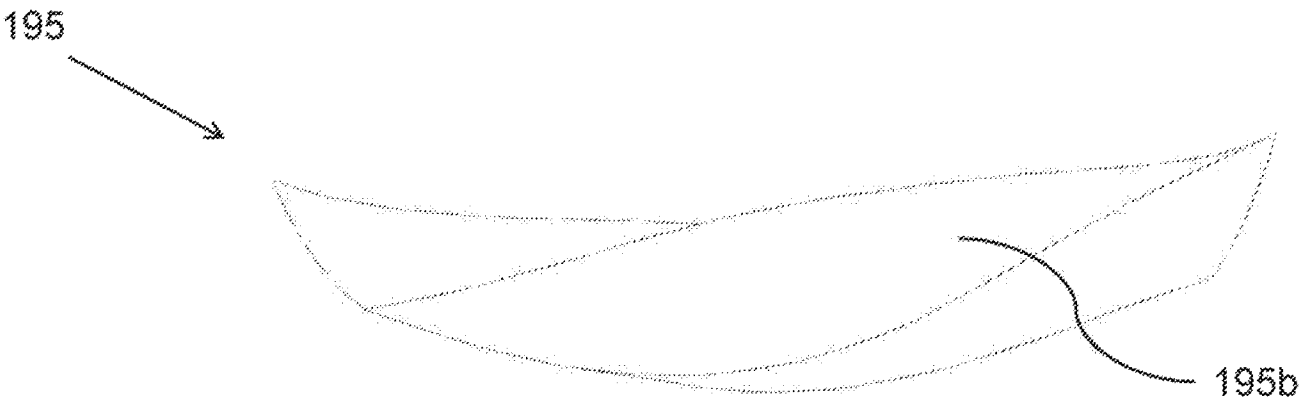
FIGS. 22*a* and 22*b* show perspective views of a piston from yet another type of rotary piston and cylinder device.
Figure 22B:
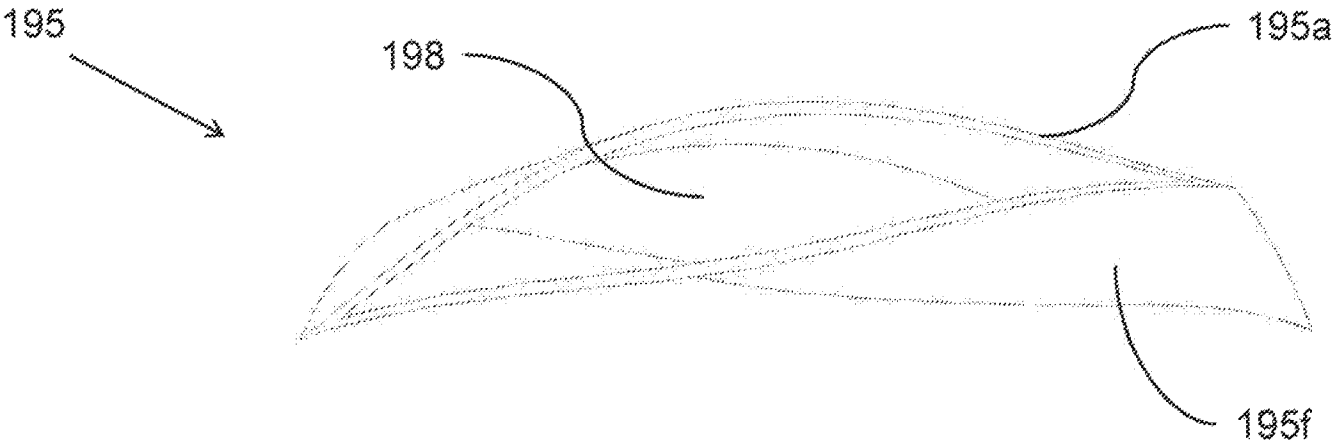

FIGS. 22*a* and 22*b* show piston 195 embodying the current invention in yet another embodiment of rotary piston and cylinder device. The piston can be seen to have a more elongated shape, but it will be understood that a working face 195*b* on a first side of the piston, a distally-arranged reverse face region 195*a* on a second side of the piston, and at least one other surface or face 195*f*, can still be identified in a similar manner. The void 198 is bounded by the distal region 195*a*.

It will be clearly apparent from the description above that there are numerous significant advantages to ensuring that the reverse side of the piston does not seal with or run relatively close to the shutter, and also in providing that an internal volume of the piston is hollow. In particular, the realisation that the reverse side does not need to completely seal, or run close to, or only partially seal with the shutter slot at all regions of the reverse side, eases manufacture of the piston, and having relaxed that requirement, it has been realised that additional functional features can be incorporated with the piston, while maintaining the sealing and or structural performance of other surfaces.

The invention claimed is:

1. A rotary piston and cylinder device comprising a rotor, a stator adjacent and maintained relative to the rotor, a surface of the stator facing a surface of the rotor to together define a working chamber, and a rotatable shutter at least partially located within the working chamber, the rotor comprising a piston extending from the surface thereof, the piston comprising a first side and a second side, the first side being arranged to seal with a slot of the shutter, and comprising a working face, the second side being a oppositely directed side to the first side, and the second side comprising a sealing portion arranged to seal with at least one of the shutter slot or the stator and a non-sealing portion arranged not to seal with the shutter slot.

2. The rotary piston and cylinder device of claim 1, wherein the sealing portion is a distal region of the second side.

3. The rotary piston and cylinder device of claim 1, wherein the non-sealing portion is devoid of a sealing or close-running surface, with respect to a surface of the slot of the shutter.

4. The rotary piston and cylinder device of claim 1, wherein the non-sealing portion is spaced from a respective slot-defining surface of shutter such that a close-running or sealing relationship is not achieved.

5. The rotary piston and cylinder device of claim 1, wherein the non-sealing portion comprises one or more openings.

6. The rotary piston and cylinder device of claim 5, wherein the one or more openings are provided in a distal region of the second side.

7. The rotary piston and cylinder device of claim 6, wherein the second side defines a recessed region or pocket or internal volume or void.

8. The rotary piston and cylinder device of claim 7, wherein the sealing portion at least in part defines the opening(s).

9. The rotary piston and cylinder device of claim 1, wherein the piston is at least in part hollow.

10. The rotary piston and cylinder device of claim 1, wherein the second side comprises a plurality of pores or is porous.

11. The rotary piston and cylinder device of claim 1, wherein the second side comprises a honeycomb structure.

12. The rotary piston and cylinder device of claim 1, wherein the second side comprises at least one heat exchange formation.

13. The rotary piston and cylinder device of claim 12, wherein the heat exchange formation comprises one or more rib or fin formations.

14. The rotary piston and cylinder device of claim 12, wherein the at least one heat exchange formation is arranged to perform a cooling effect to the piston.

15. The rotary piston and cylinder device of claim 1, wherein the second side includes one or more strengthening formations.

16. The rotary piston and cylinder device of claim 15, wherein the one or more strengthening formations comprise one or more ribs.

17. The rotary piston and cylinder device of claim 1, wherein the non-sealing portion of the second side is offset or set back relative to the sealing portion.

18. The rotary piston and cylinder device of claim 1, wherein the sealing portion of the second side comprises a peripheral region of the second side.

19. The rotary piston and cylinder device of claim 1, wherein the sealing portion comprises an edge portion or region of the second side.

* * * * *